US007906264B2

(12) United States Patent
Takahashi et al.

(10) Patent No.: US 7,906,264 B2
(45) Date of Patent: Mar. 15, 2011

(54) ELECTROSTATIC LATENT IMAGE DEVELOPING TONER AND METHOD FOR PRODUCING THE SAME, AND ELECTROSTATIC LATENT IMAGE DEVELOPER, TONER CARTRIDGE, PROCESS CARTRIDGE AND IMAGE FORMING APPARATUS

(75) Inventors: Masaru Takahashi, Kanagawa (JP); Hirokazu Hamano, Kanagawa (JP); Atsushi Sugawara, Kanagawa (JP); Masaki Nakamura, Kanagawa (JP); Yasuhiro Oya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 920 days.

(21) Appl. No.: 11/705,002

(22) Filed: Feb. 12, 2007

(65) Prior Publication Data

US 2008/0057430 A1 Mar. 6, 2008

(30) Foreign Application Priority Data

Sep. 5, 2006 (JP) ..... 2006-240344

(51) Int. Cl.
*G03G 9/00* (2006.01)

(52) U.S. Cl. ..... 430/109.4; 430/110.4; 430/111.4; 399/252

(58) Field of Classification Search ..... 430/109.4, 430/110.4, 111.4; 399/252
See application file for complete search history.

(56) References Cited

U.S. PATENT DOCUMENTS

| | | | | |
|---|---|---|---|---|
| 3,853,778 | A | 12/1974 | Buckley et al. | |
| 6,195,515 | B1 | 2/2001 | Fujita et al. | |
| 2003/0104296 | A1 * | 6/2003 | Hamano et al. | 430/107.1 |
| 2006/0105258 | A1 | 5/2006 | Ishiyama et al. | |
| 2006/0216625 | A1 * | 9/2006 | Maehata et al. | 430/109.3 |

FOREIGN PATENT DOCUMENTS

| | | | |
|---|---|---|---|
| CN | 1247333 | A | 3/2000 |
| CN | 1776533 | A | 5/2006 |
| JP | B2 56-13943 | | 4/1981 |
| JP | B2 62-39428 | | 8/1987 |
| JP | A 2004-206081 | | 7/2004 |
| JP | A 2004-264582 | | 9/2004 |
| JP | A 2004-264584 | | 9/2004 |
| JP | A-2006-091564 | | 4/2006 |

OTHER PUBLICATIONS

Notice of Reasons for Rejection with English-language translation for Japanese Application No. 2006-240344, issued Nov. 9, 2010.

* cited by examiner

*Primary Examiner* — Mark A Chapman
(74) *Attorney, Agent, or Firm* — Oliff & Berridge, PLC

(57) ABSTRACT

The invention provides: an electrostatic latent image developing toner comprising a non-crystalline resin, a crystalline resin having a melting point of 50 to 100° C., and a colorant, and satisfying the relationship represented by the following formula (1), wherein A represents the content of the crystalline resin (% by mass) in the entire toner, and B represents the content of the crystalline resin (% by mass) in a classified toner which has been prepared by classifying the toner such that the volume average particle diameter thereof is in the range of (1/5)×D50T to (2/3)×D50T, wherein D50T represents the volume average particle diameter of the entire toner, and a method for producing the same, as well as an electrostatic latent image developing developer, a toner cartridge, a process cartridge, and an image forming apparatus using the same.

$$50 \leqq (B/A) \times 100 \leqq 90 \qquad \text{Formula (1)}$$

12 Claims, 2 Drawing Sheets

ELECTROSTATIC LATENT IMAGE DEVELOPING TONER AND METHOD FOR PRODUCING THE SAME, AND ELECTROSTATIC LATENT IMAGE DEVELOPER, TONER CARTRIDGE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2006-240344 filed in Sep. 5, 2006.

BACKGROUND

1. Technical Field

The present invention relates to an electrostatic latent image developing toner and a method for producing the same, and an electrostatic latent image developer, a toner cartridge, a process cartridge, and an image forming apparatus.

2. Related Art

In electrophotography, in general, an image is formed through plural processes including electrically forming a latent image on the surface of a photoreceptor (latent image holding member) using a light conductive substance by various means, developing the formed latent image using a developer to form a toner image, followed by transferring the toner image to the surface of a transfer material such as paper, as necessary, via an intermediate transfer medium, and fixing the image by heating, pressurization, heating pressurization or the like. The toner remaining on the photoreceptor surface is usually cleaned by a cleaning process using a blade.

As a fixing technique for fixing a toner image which has been transferred onto the surface of a transfer material, a heat roll fixing method is generally known. In this method, a transfer material, onto which a toner image has been transferred, is inserted between a pair of rolls including a heat roll and a pressure roll and fixed the toner image. Further, as the same type of technique, a fixing method in which one or both of the rolls is replaced with a belt is also known. In these techniques, compared to other fixing methods, a fast image is obtained quickly, and energy efficiency is high due to direct contact with an image.

In recent years, along with the growing demand for savings of energy necessary for image formation, a technique for lowering the fixing temperature of a toner is demanded in order to reduce the amount of energy used for the fixing process, which accounts for a measure of energy usage, and to expand the fixing conditions. Lowering of the toner fixing temperature brings big advantages such as, in addition to the energy saving and expansion of fixing conditions, shortening of the so-called warm-up time, i.e., the latency time until the surface of a fixing member such as a fixing roll reaches the temperature capable of fixing upon switch-on, and enhancement of the service life of the fixing member.

As a method for lowering the fixing temperature of a toner, a technique for lowering the glass transition temperature of a toner resin (binding resin) is commonly employed. However, in the technique, if the glass transition temperature is too low, fine particles readily cause aggregation (blocking). Therefore, it is important to strike a balance between the low temperature fixing property and the prevention of blocking.

SUMMARY

According to an aspect of the present invention, there is provided an electrostatic latent image developing toner comprising a non-crystalline resin, a crystalline resin having a melting point of 50 to 100° C., and a colorant, and satisfying the relationship represented by the following formula (1), wherein A represents the content of the crystalline resin (% by mass) in the entire toner, and B represents the content of the crystalline resin (% by mass) in a classified toner which has been prepared by classifying the toner such that the volume average particle diameter thereof is in the range of (⅕)×D50T to (⅔)×D50T, wherein D50T represents the volume average particle diameter of the entire toner.

$$50 \leqq (B/A) \times 100 \leqq 90 \qquad \text{Formula (1)}$$

BRIEF DESCRIPTION OF THE DRAWINGS

Exemplary embodiment(s) of the present invention will be described in detail based on the following figures, wherein.

DETAILED DESCRIPTION

Figure 1:
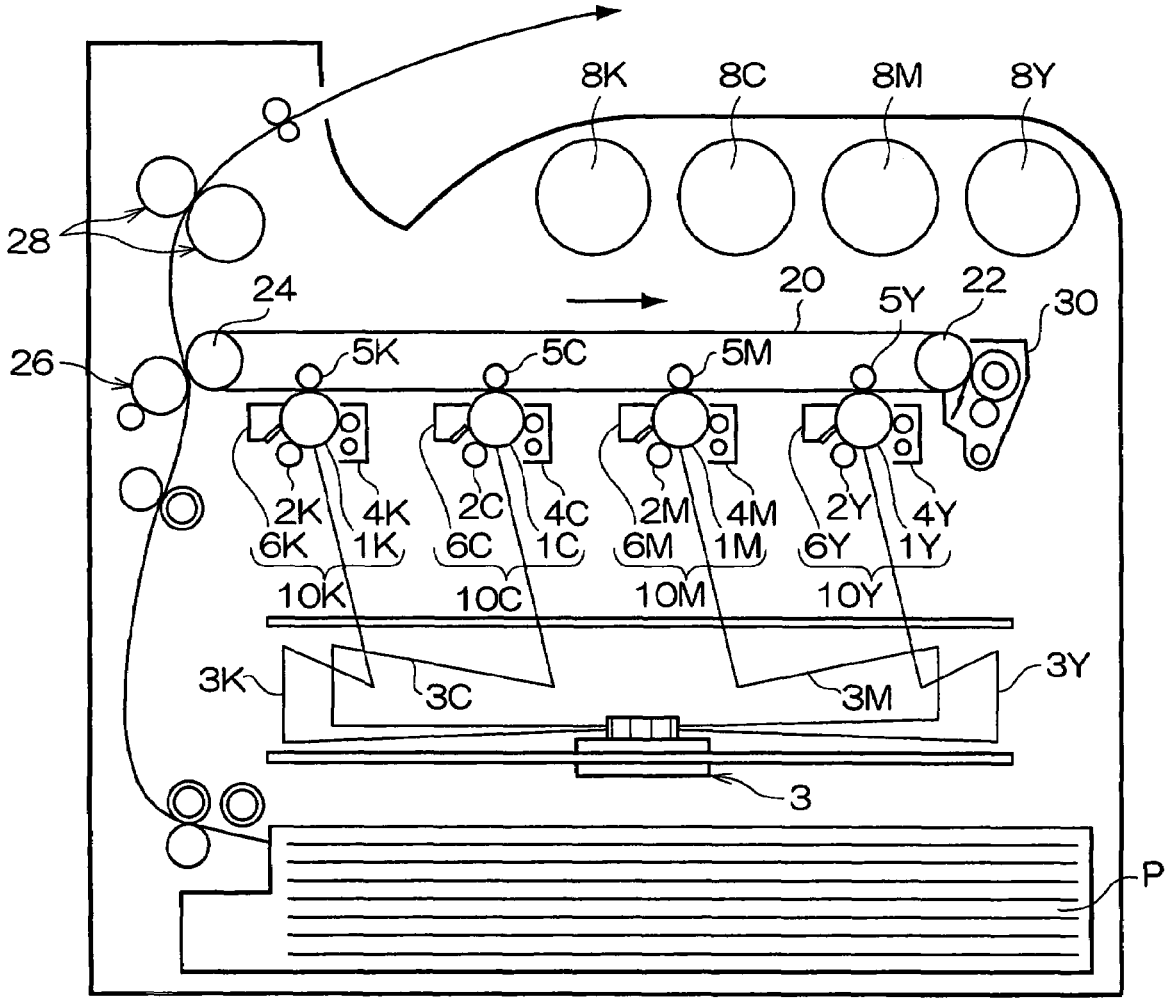
FIG. 1 is a schematic block diagram representing an example of the image forming apparatus of the invention.

The present invention is further described in detail below.

<Electrostatic Latent Image Developing Toner>

The electrostatic latent image developing toner of the invention (hereinafter may be simply referred to as "toner") comprises a non-crystalline resin, a crystalline resin having a melting point of 50 to 100° C., and a colorant, and satisfying the relationship represented by the following formula (1), wherein A represents the content of the crystalline resin (% by mass) in the entire toner, and B represents the content of the crystalline resin (% by mass) in a classified toner which has been prepared by classifying the toner such that the volume average particle diameter thereof is in the range of (⅕)×D50T to (⅔)×D50T, wherein D50T represents the volume average particle diameter of the entire toner.

$$50 \leqq (B/A) \times 100 \leqq 90 \qquad \text{Formula (1)}$$

In general, when a toner is pressed on a photoreceptor by a cleaning blade in the cleaning process, impalpable powder tends to be placed in the recesses of the contact zone between the cleaning blade and a photoreceptor (a side nearer to the contact position), and receive a higher pressure from the cleaning blade. Accordingly, even if the entire toner particles are not heated by the friction with the photoreceptor, the surface temperature thereof may be increased momentarily. Therefore, for example, when a crystalline resin having a melting point of 50 to 100° C. is contained in the toner from the viewpoint of low temperature fixing, the rise of the resin temperature causes the rapid decrease of the toner viscosity, in turn the toner is readily deformed. As a result, the pressure applied by the cleaning blade further increases, which may cause filming (filmy adhesion) on the photoreceptor or the like, or the toner pressed by the cleaning blade is detected as a cleaning defect.

The above-described low temperature fixing refers to fixing of a toner by heating at a temperature of 120° C. or lower.

On the other hand, when a toner containing a crystalline resin is to be formed in a small particle diameter, it is advantageous to use an emulsion aggregation, which will be described later. In the emulsion aggregation method, in general, resin particles having a smaller particle diameter more readily fuse in the fusion process. Further, the crystalline resin contained in the impalpable powder of the toner accelerates the fusion of the above-described resin particles, and promotes the fusion to produce more fine impalpable powder in the toner. As a result, a shape distribution of the whole toner is widened, and the shape of the impalpable powder in the toner becomes very round. When the shape of the impalpable powder is rounded as described above, the impalpable spherical powder of the toner readily passes through the cleaning blade during cleaning with the blade, which tends to cause a cleaning defect. Further, if the conditions of the cleaning blade are tightened in order to inhibit the passage of the impalpable powder toner, the impalpable powder toner is destroyed to cause filming adhering to the surface of the photoreceptor and others.

Thus, when a crystalline resin is contained in the toner, it is important to control the amount of the crystalline resin contained in the impalpable powder toner in terms of the generation mechanism of the toner particles for preventing fogging, cleaning defects, and filming.

As a result of the eager investigation by the inventors of the invention, the following fact was found. That is, when a non-crystalline resin and a crystalline resin having a melting point of 50 to 100° C. is contained in the toner, when the toner satisfies the relationship represented by the following formula (1), wherein A represents the content of the crystalline resin (% by mass) in the entire toner, and B represents the content of the crystalline resin (% by mass) in a classified toner which has been prepared by classifying the toner such that the volume average particle diameter thereof is in the range of (⅕)×D50T to (⅔)×D50T, wherein D50T represents the volume average particle diameter of the entire toner, more specifically, by further decreasing the content of the crystalline resin in finer impalpable powder toner, the deformation of the impalpable powder toner by the pressure of the above-described cleaning blade is reduced, and the occurrence of filming or cleaning defects is inhibited.

$$50 \leqq (B/A) \times 100 \leqq 90 \qquad \text{Formula (1)}$$

The term "crystallinity" in the above-described crystalline resin means that, in differential scanning calorimetry (DSC), the resin does not show a stepwise endothermic change, but specifically has an endothermic peak having a half width of 10 (° C.) or lower when measured at a temperature rising rate pf 10 (° C./min). On the other hand, a resin having a half width exceeding 10° C. or a resin showing a stepwise endothermic change means a non-crystalline resin (amorphous polymer) in the invention.

Further, as a method for classifying the above-described toner to reduce the volume average particle diameter D50T to ⅕ to ⅔, an elbow jet classification method is used. In this case, for example, by setting the cut point of the elbow jet to (⅚)×D50T, a toner having a volume average particle diameter of (⅔)×D50T is obtained.

The reason for limiting the volume average particle diameter D50T to the range from ⅕ to ⅔ is that it is an effective range for examining the ratio of the crystalline resin and the non-crystalline resin on the impalpable powder side by the classification means. When D50T is more than ⅔, it is insufficient as the information about the ratio on the impalpable powder side, and it is practically difficult to reduce D50T smaller than ⅕.

The above-described volume average particle diameter D50T may be determined by Multisizer II (manufactured by Beckman-Coulter) at an aperture diameter of 50 μm. In this case, the determination is carried out after the toner is dispersed in an electrolyte aqueous solution (isotone aqueous solution), and ultrasonically dispersed for 30 seconds or more.

With regard to the above-described ratio of the content of the crystalline resin in the toner (B/A), (B/A)×100 satisfy the relationship represented by the formula (1). When (B/A)×100 is less than 50, the ratio of the impalpable powder toner containing a large amount of non-crystalline resin is increased, which deteriorates the fixing property and offset resistance. When exceeding 90, cleaning defects and filming on the photoreceptor and others occur.

The above-described A and B preferably satisfy the relationship represented by the following formula (2), and more preferably satisfy the relationship represented by the following formula (2').

$$50 \leqq (B/A) \times 100 \leqq 80 \qquad \text{Formula (2)}$$

$$50 \leqq (B/A) \times 100 \leqq 70 \qquad \text{Formula (2')}$$

The content of the crystalline resin in the toner (A %, B %) was determined by subjecting the toner before and after classification to differential scanning calorimetry (DSC) for determining the heat of fusion of the crystalline resin. Specifically, in the first place, a known amount of crystalline resin and non-crystalline resin were mixed and subjected to DSC to prepare a calibration curve of the endothermic amount and the content of the crystalline resin (% by mass). Subsequently, the toner sample before and after classification which had been subjected to annealing treatment at 50° C. for 24 hours was subjected to DSC. Then, the content A and B (% by mass) of the crystalline resin in each toner were determined from the result and the calibration curve, and (B/A) was calculated. DSC was carried out under conditions from 20° C. to 150° C. at a temperature rising rate of 10° C./minute.

The composition of the electrostatic latent image developing toner of the invention is further described below in detail.

The toner of the invention contains at least a non-crystalline resin and a crystalline resin having a melting point of 50 to 100° C.

(Crystalline Resin)

Examples of the crystalline resin include a crystalline polyester resin, polyalkylene resin, and long-chain alkyl (meth) acrylate resin. It is preferable to use a crystalline polyester resin from the viewpoints of the above-described steep viscosity change by heating, and the balance between the mechanical strength and low temperature fixing.

Further, as a polymerizable monomer component composing the crystalline resin, a polymerizable monomer having a straight-chain aliphatic component is more preferable than a polymerizable monomer having an aromatic component in order to readily form a crystal structure. Further, the content of the components derived from the polymerizable monomers in the polymer is preferably each 30 mol % or more as a single component for not impairing the crystallinity. In particular, the content of the components derived from a polymerizable monomers in a polyester resin or the like, which is essentially composed of two or more polymerizable monomers, is preferably each 30 mol % or more as a single component.

The crystalline resin is further described below mainly with regard to a crystalline polyester resin.

The melting point of the crystalline polyester resin used in the invention is in the range 50 to 100° C., more preferably in the range of 55 to 90° C., and further preferably in the range of 60 to 85° C. If the melting point is lower than 50° C., problems with toner storage property such as blocking of a stored toner may occur, and the storage property of the fixed image after fixing may be impaired. On the other hand, if the melting point exceeds 100° C., sufficient low temperature fixing property is not obtained.

The above-described melting point of the crystalline polyester resin was determined as the peak temperature of the endothermic peak obtained by the above-described differential scanning calorimetry (DSC).

In the invention, the term "crystalline polyester resin" means a polymer composed of a 100% polyester structure, as well as a polymer in which a component composing polyester and other components are polymerized (copolymer). However, in the latter case, the content of the other components except for polyester composing the polymer (copolymer) is 50% by mass or less.

The crystalline polyester resin used in the toner of the invention is, for example, synthesized from a polyvalent carboxylic acid component and a polyhydric alcohol component. In the present embodiment, a commercial product or a synthesized compound may be used as the above-described crystalline polyester resin.

Examples of the polyvalent carboxylic acid component include but not limited to aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, or 1,18-octadecanedicarboxylic acid; aromatic dicarboxylic acids of dibasic acids such as phthalic acid, isophthalic acid, terephthalic acid, naphthalene-2,6-dicarboxylic acid, malonic acid, or mesaconic acid; and anhydrides and lower alkyl esters thereof.

Examples of the trivalent or more carboxylic acid include 1,2,4-benzenetricarboxylic acid, 1,2,5-benzenetricarboxylic acid, and 1,2,4-naphthalenetricarboxylic acid, and anhydrides and lower alkyl esters thereof. These may be used alone or in combination of two or more of them.

Further, as the acid component, in addition to the above-described aliphatic dicarboxylic acid and aromatic dicarboxylic acid, a dicarboxylic acid component having a sulfonic acid group may be contained.

Further, in addition to the above-described aliphatic dicarboxylic acid and aromatic dicarboxylic acid, a dicarboxylic acid component having a double bond may be contained.

As the polyhydric alcohol component, an aliphatic diol is preferable, and a straight-chain aliphatic diol having 7 to 20 carbon atoms in the main chain thereof is more preferable. When the aliphatic diol is of branched type, the crystallinity of the polyester resin may be decreased, which result in the decrease of the melting point thereof Further, when the diol having less than 7 carbon atoms in the main chain thereof is polycondensed with an aromatic dicarboxylic acid, the fusion temperature rises and the rise of the fusion temperature makes low temperature fixing difficult. On the other hand, when the carbon atoms in the main chain exceed 20, it tends to be difficult to obtain a practical material. The carbon atoms in the main chain are more preferably 14 or less.

Specific examples of aliphatic diols which are preferably used for the synthesis of the crystalline polyester used in the toner of the invention include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol, but are not limited to them. Among them, 1,8-octanediol, 1,9-nonanediol, and 1,10-decanediol are preferable in consideration of availability.

Examples of alcohols of trivalent or more include glycerol, trimethylolethane, trimethylolpropane, and pentaerythritol. These may be used alone or in combination of two or more of them.

In the polyhydric alcohol components, the content of the above-described aliphatic diol is preferably 80 mol % or more, and more preferably 90% or more. If the content of aliphatic diol is less than 80 mol %, crystallinity of the polyester resin decreases and the fusion temperature decreases, which may deteriorate the toner blocking resistance, image storage stability, and low temperature fixing property.

As needed, a polyvalent carboxylic acid or a polyhydric alcohol may be added in the final step of the synthesis for the purpose of adjusting the acid value or hydroxyl value. Examples of the polyvalent carboxylic acid include aromatic carboxylic acids such as terephthalic acid, isophthalic acid, phthalic anhydride, trimellitic anhydride, pyromellitic acid, or naphthalene dicarboxylic acid; aliphatic carboxyl acid such as maleic anhydride, fumaric acid, succinic acid, alkenyl succinic anhydride, or adipic acid; and alicyclic carboxylic acids such as cyclohexane dicarboxylic acid.

Example of the polyhydric alcohol include aliphatic diols such as ethylene glycol, diethylene glycol, triethylene glycol, propylene glycol, butane diol, hexane diol, neopentyl glycol, or glycerol; alicyclic diols such as cyclohexane diol, cyclohexane dimethanol, or hydrogenated bisphenol A; and aromatic diols such as ethylene oxide adduct of bisphenol A or propylene oxide adduct of bisphenol A.

The above-described crystalline polyester resin may be produced at a polymerization temperature of 180 to 230° C., and the reaction is carried out in a reaction system which is decompressed if necessary, while water and alcohol generated during condensation is being removed.

When a polymerizable monomer is insoluble or incompatible at the reaction temperature, a high boiling point solvent may be added as a solubilizing agent to dissolve the insoluble or incompatible polymerizable monomer. The polycondensation reaction is carried out with the solubilizing solvent is removed by evaporation. When a polymerizable monomer having poor compatibility is present in copolymerization reaction, the polymerizable monomer having poor compatibility should be previously condensed with an acid or alcohol which is to be polycondensed with the polymerizable monomer, and then polycondensed with the main component.

Examples of the catalyst which may be used for producing the above-described polyester resin include alkali metal compounds such as sodium or lithium; alkaline earth metal compounds such as magnesium or calcium; metal compounds such as zinc, manganese, antimony, titanium, tin, zirconium, or germanium; phosphorous acid compounds; phosphoric acid compounds; and amine compounds.

Specific examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tin tetraphenyl, dibutyltin dichloride, dibutyltin oxide, diphenyltin oxide, zirconium tetrabutoxide, zirconium naphthenate, zirconyl carbonate, zirconyl acetate, zirconyl stearate, zirconyl octoate, germanium oxide, triphenyl phosphite, tris(2,4-di-t-butylphenyl)phosphite, ethyltriphenyl phosphonium bromide, triethyl amine, triphenyl amine, and other compounds.

The acid value of the crystalline polyester resin used in the invention (the number of milligrams of KOH necessary to neutralize 1 g of resin) is preferably in the range of 3.0 to 30.0 mg KOH/g, more preferably in the range of 6.0 to 25.0 mg KOH/g, and further preferably in the range of 8.0 to 20.0 mg KOH/g.

If the acid value is lower than 3.0 mg KOH/g, the preparation of the emulsification particles by a wet process may be significantly difficult because of the decrease of the dispersibility in water. Furthermore, the stability as emulsification particles during aggregation is significantly decreased, thus it may be difficult to efficiently prepare the toner. On the other hand, if the acid value exceeds 30.0 mg KOH/g, the moisture absorption property as a toner increases, and this may make the toner susceptible to environmental effects.

Further, the weight average molecular weight (Mw) of the crystalline polyester resin is preferably 6,000 to 35,000. If the molecular weight (Mw) is less than 6,000, the toner may penetrate into the surface of a recording medium such as paper during fixing to cause uneven fixing, or decrease the strength of the fixed image for bending resistance. On the other hand, if the weight average molecular weight (Mw) exceeds 35,000, the viscosity upon fusion becomes so high that the temperature for achieving a viscosity suitable for fixing may increase, as a result, which may impair the low temperature fixing property.

The above-described weight average molecular weight may be determined by gel permeation chromatography (GPC). The molecular weight determination by GPC was carried out using GPC-HLC-8120; a determination apparatus manufactured by Tosoh Corporation, TSK gel Super HM-M (15 cm), a column manufactured by Tosoh Corporation, and THF as an eluent. The weight average molecular weight was calculated from the determination result using a molecular weight calibration curve which had been prepared with a monodispersed polystyrene standard sample.

The content of the crystalline polyester resin in the toner is preferably in the range of 3 to 40% by mass, more preferably in the range of 4 to 35% by mass, and further preferably in the range of 5 to 30% by mass. If the content of the crystalline polyester resin is less than 3% by mass, a sufficient low temperature fixing property may not be obtained, and if exceeding 40% by mass, sufficient toner strength and fixing image strength may not be obtained, and the charging property may be affected.

Above crystalline resins including a crystalline polyester resin is preferably composed mainly of a crystalline polyester resin (hereinafter may be referred to as "crystalline aliphatic polyester resin") which has been synthesized using an aliphatic polymerizable monomer (50% by mass or more). Further in this case, the constituent ratio of the aliphatic polymerizable monomer composing the above-described crystalline aliphatic polyester resin is preferably 60 mol % or more, and more preferably 90 mol % or more. As the aliphatic polymerizable monomer, the above-described aliphatic diols or dicarboxylic acids may be preferably used.

(Non-Crystalline Resin)

As the non-crystalline resin in the invention, known resin materials such as a styrene/acrylic resin, epoxy resin, polyester resin, poly urethane resin, polyamide resin, cellulose resin, polyether resin, or polyolefin resin may be used, and a non-crystalline polyester resin is particularly preferable.

When a non-crystalline polyester resin is used, compatibility with the above-described crystalline polyester resin is improved. Therefore, along with the decrease in the viscosity of the crystalline polyester resin at the fusion temperature, the viscosity of the non-crystalline polyester resin also decreases, and a sharp-melt property (a sharp melting property) as a toner is obtained, which is advantageous for the low temperature fixing property. Further, the favorable wettability with a crystalline polyester resin improves the dispersibility of the crystalline polyester resin into an inner of the toner to inhibit the exposure of the crystalline polyester resin at the toner surface, which inhibits the deleterious effect on the charging property. On this account, the resin is preferable also from the viewpoints of improvement of the strength of the toner and fixed image.

The non-crystalline resin in the invention is further described below mainly with regard to a non-crystalline polyester resin.

The non-crystalline polyester resin which is preferably used in the present invention is obtained by, for example, polycondensation of polyvalent carboxylic acids and polyhydric alcohols. Examples of the polyvalent carboxylic acid include aromatic carboxylic acids such as terephthalic acid, isophthalic acid, phthalic anhydride, trimellitic anhydride, pyromellitic acid, or naphthalenedicarboxylic acid; aliphatic carboxylic acids such as maleic anhydride, fumaric acid, succinic acid, alkenyl succinic anhydride, or adipic acid; and alicyclic carboxylic acids such as cyclohexanedicarboxylic acid. One or two or more of these polyvalent carboxylic acids may be used. Among these polyvalent carboxylic acids, it is preferable to use an aromatic carboxylic acid, and in order to form a crosslinking or branched structure for securing a favorable fixing property, it is preferable to use a trivalent or more carboxylic acid (e.g., trimellitic acid or an anhydride thereof) in combination with a dicarboxylic acid.

Examples of the above-described polyhydric alcohol in the non-crystalline polyester resin include aliphatic diols such as ethylene glycol, diethylene glycol, triethylene glycol, propylene glycol, butanediol, hexane diol, neopentyl glycol, or glycerol; alicyclic diols such as cyclohexane diol, cyclohexanedimethanol, or hydrogenated bisphenol A; and aromatic diols such as ethylene oxide adduct of bisphenol A or propylene oxide adduct of bisphenol A. One or two or more of these polyhydric alcohols may be used. Among these polyhydric alcohols, aromatic diols and alicyclic diols are preferable, and aromatic diols are more preferable. Further, in order to form a crosslinking or branched structure for securing a favorable fixing property, it is preferable to use a trivalent or more polyhydric alcohol (glycerol, trimethylol propane, or pentaerythritol) in combination with a diol.

The glass transition temperature (Tg) of the above-described non-crystalline polyester resin is preferably in the range of 50 to 80° C. If the Tg is lower than 50° C., problems may occur in the storage stability of the toner or the storage stability of the fixed image. On the other hand, if the Tg is higher than 80° C., fixing at a lower temperature than conventional methods may be impossible.

The Tg of the non-crystalline polyester resin is more preferably in the range of 50 to 65° C.

Further, the non-crystalline polyester resin preferably satisfies the relationship represented by the following formula (6), wherein SPA represents the solubility parameter of the crystalline polyester resin, and SPB represents the solubility parameter of the non-crystalline polyester resin.

$$SPB-SPA<0.7 \qquad \text{Formula (6)}$$

The above-described solubility parameter (hereinafter may be referred to as "SP value") may be calculated from the composition of the polymerizable monomer according to the following formula (7) using the method of Fedors et al. [Polym. Eng. Sci., vol 14, p 147 (1974)]

which utilizes the additive property of the atomic group.

$$SP\ \text{value}=(\Sigma\Delta ei/\Sigma\Delta vi)^{1/2} \qquad \text{Formula (7)}$$

(In the above formula, Δei represents the evaporation energy of the atom or the atomic group, and Δvi represents the mole volume of the atom or the atomic group.)

In the formula (6), if the difference between SPB and SPA is 0.7 or more, the compatibility between the crystalline polyester resin and the non-crystalline polyester resin decreases. As a result, the dispersibility of the crystalline polyester resin in the toner deteriorates and the crystalline polyester resin is exposed at the toner surface, which may result in the deterioration of the charging property. Further, the wettability of the crystalline polyester resin and non-crystalline polyester resin decrease, which may decrease the strength of the toner or the strength of the fixed image.

The non-crystalline polyester resin may be produced according to the procedure for the crystalline polyester resin.

The crystalline resin and the non-crystalline resin in the invention are described above with regard to a crystalline polyester resin and a non-crystalline polyester resin, and the description except for the production of the polyester resins may be applied to other crystalline resins and non-crystalline resins in the invention.

(Colorant)

The colorant used in the toner of the invention may be a dye or a pigment, and preferably a pigment from the viewpoint of light resistance and water resistance.

Examples of preferable colorants include known pigments such as carbon black, aniline black, aniline blue, chalcoil blue, chromium yellow, ultramarine blue, Du Pont oil red, quinoline yellow, methylene blue chloride, phthalocyanine blue, malachite green oxalate, lamp black, rose bengal, quinacridone, benzidine yellow, C. I. pigment red 48:1, C.I. pigment red 57:1, C.I. pigment red 122, C.I. pigment red 185, C.I. pigment red 238, C.I. pigment yellow 12, C.I. pigment yellow 17, C.I. pigment yellow 180, C.I. pigment yellow 97, C.I. pigment yellow 74, C.I. pigment blue 15:1, or C.I. pigment blue 15:3.

The content of the above-described colorant in the electrostatic latent image developing toner of the invention is preferably in the range of 1 to 30 parts by mass relative to 100 parts by mass of the binding resin. Further, as needed, it is also effective use a surface-treated colorant or a pigment dispersant. By selecting the kind of the colorant, a yellow toner, magenta toner, cyan toner, black toner or the like is obtained.

(Other Additives)

The toner of the invention may contain a releasing agent as needed. Examples of the releasing agent include paraffin wax such as low molecular weight polypropylene or low molecular weight polyethylene; silicone resin; rosins; rice wax; and carnauba wax. The melting point of these releasing agents is preferably 50° C. to 100° C., and more preferably 60° C. to 95° C. The content of the toner in the releasing agent is preferably 0.5 to 15% by mass, and more preferably 1.0 to 12% by mass. If the content of the releasing agent is less than 0.5% by mass, a peeling defect may occur particularly in oilless fixing. If the content of the releasing agent is more than 15% by mass, the reliability of the image quality and image formation may be decreased due to the deterioration of the toner mobility and others.

To the toner of the invention, in addition to the above-described components, various components such as an internal additive, charge controlling agent, inorganic powder (inorganic particle), or organic particles may be added as needed. Examples of the internal additive include metals such as ferrite, magnetite, reduced iron, cobalt, nickel, or manganese, alloys, and magnetic substances such as a compound containing these metals.

The inorganic particles are added for various purposes, and may be added for adjusting the viscoelastic property in the toner. The adjustment of the viscoelastic property allows adjusting the glossiness of the image and the penetration into paper. As the inorganic particles, known inorganic particles such as silica particles, titanium oxide particles, alumina particles, cerium oxide particles, or these particles which have been subjected surface hydrophobization may be used alone or in combination or two or more. From the viewpoints of not impairing the color forming property and transparency such as OHP permeability, silica particles which have a smaller refractive index than a binding resin are preferably used as the inorganic particles. Further, silica particles may have been subjected to various surface treatments, and for example, those have been subjected to surface treatment with a silane-based coupling agent, titanium-based coupling agent, or silicone oil is preferably used.

(Properties of Toner)

In the invention, the volume average particle diameter of the toner is preferably in the range of 4 to 9 μm, more preferably in the range of 4.5 to 8.5 μm, and further preferably in the range of 5 to 8 μm. If the volume average particle diameter is smaller than 4 μm, the toner mobility tends to decrease, the charging property of the particles tends to decrease, and fogging of the background, the spill of the toner from the developing device or the like tends to occur due to widening of the charging distribution. Moreover, if the volume average particle diameter is smaller than 4 μm, the cleanability may be significantly problematic. On the other hand, the volume average particle diameter is larger than 9 μm, the resolution deteriorates, thus a sufficient image quality may be not achieved, and it may become difficult to satisfy the recent demand for a high quality image.

The above-described volume average particle diameter is equivalent to the volume average particle diameter D50T in the above-described entire toner, and may be determined according to the above-described determination method.

Further, since the impalpable powder in the toner tends to be hard to be cleaned, it is very import from the viewpoint of maintaining the above-described favorable cleanability to narrow the particle diameter distribution on the small particle diameter side in the toner particle diameter distribution, and satisfy the relationship represented by the above-described formula (1). From that viewpoint, in the volume particle diameter distribution of the toner of the invention, the number average particles size distribution index of a small particle size side GSD p-under is preferably in the range of 1.15 to 1.30, and more preferably in the range of 1.15 to 1.25. In order to maintain a favorable cleanability, the particle diameter distribution on the impalpable powder side is important in terms of the mechanism. If the GSD p-under exceeds 1.30, the amount of the impalpable powder in the toner is increased, which may result in difficulty of maintaining a favorable cleanability. It is practically difficult to obtain a GSD p-under of less than 1.15.

The number average particles size distribution index of a small particle size side GSD p-under is determined as described below. That is, according to the above-described determination of D50T, the particle diameter distribution of the toner is determined using Multisizer II (manufactured by Beckman-Coulter) as a measuring device, and the distribution is plotted against the divided particle diameter range (channel) to draw a cumulative distribution for the number of respective toner particles from the small diameter side. When the particle diameter corresponding cumulative 16% is defined as the number average particle diameter D16*p* and the particle diameter corresponding to cumulative 50% is defined as D50*p*, the number average particles size distribution index of a small particle size side GSD p-under is calculated as (D50*p*/D16*p*).

In particular, when a crystalline polyester resin is contained in the toner, cleaning defects tend to occur remarkably when the amount of the above-described impalpable powder is increased, due to the decrease of the mechanical strength of the toner or the increase of the non-electrostatic adhesion force. Therefore, it is preferable to define the particle diameter distribution on the above-described impalpable powder side, as well as to reduce the content of the crystalline polyester resin in the 10% by mass of particles on the small particle diameter side, which is usually difficult to clean, lower than the content in the entire toner.

More specifically, depending on the major particle diameter of the toner and the distribution on the impalpable powder side, at least $(B'/A)\times100$ is preferably 90 or less, and more preferably 85 or less, wherein A is the content of the crystalline polyester resin (% by mass) in the entire toner, and B' is the content of the crystalline polyester resin (% by mass) in the 10% by mass of particles on the small particle diameter side. On the other hand, if $(B'/A)\times100$ is less than 50, it is preferable from the viewpoints of cleanability and charging property, but the toner may cause a fixing defect upon fixing to cause a minute offset.

Further, the toner of the invention preferably has a spherical shape having a shape factor SF1 in the range of 110 to 140. When the toner has a spherical shape in the range, the transfer efficiency and image denseness are improved, and an image of high quality is formed.

The above-described shape factor SF1 is more preferably in the range of 110 to 130.

The shape factor SF1 is determined by the following formula (8).

$$SF1=(ML^2/A)\times(\pi/4)\times100 \quad \text{Formula (8)}$$

In the above-described formula (8), ML represents the absolute maximum length of the toner particles, and A represents the projected area of the toner particles.

The above-described SF1 is converted into a number mainly by analyzing a microscope image or scanning electron microscope (SEM) image with an image analyzer, and calculated, for example, as follows. That is, an optical microscope image of toner particles distributed on the surface of a slide glass is taken in a Luzex image analyzer via a video camera, the maximum length and the projected area of 100 particles are measured, calculation is carried out by the above-described formula (8), and the average is calculated to obtain the SF1.

As a method for producing the electrostatic latent image developing toner of the invention, dry and wet processes are exemplified. However, a mixing and grinding method, which is one of dry processes, is not preferable because the content of the crystalline resin in the impalpable powder toner tends to increase as described above. Examples of wet processes include an emulsifying aggregation method, melting suspension method, and solution suspension method. Among them, the emulsion aggregation method is preferable from the viewpoint of controlling of the particle diameter distribution, particularly narrowing the distribution on the small particle diameter side.

The method for producing the electrostatic image developing toner of the invention by the above-described emulsion aggregation method is described below.

<Production Method of Electrostatic Latent Image Developing Toner>

The method for producing the electrostatic latent image developing toner of the invention comprises emulsifying a crystalline resin and a non-crystalline resin in separate aqueous media to form crystalline resin particles and non-crystalline resin particles, respectively; aggregating the crystalline resin particles and the non-crystalline resin particles to form agglomerated particles; and fusing the agglomerated particles, wherein the coagulation value C (mol/g resin) of the crystalline resin particles and the coagulation value D (mol/g resin) of the non-crystalline resin particles satisfy the relationships represented by the following formulae (3) to (5):

$$1\times10^{-5}\leqq C\leqq1\times10^{-1} \quad \text{Formula (3)}$$

$$1\times10^{-5}\leqq D\leqq1\times10^{-1} \quad \text{Formula (4)}$$

$$C\leqq D \quad \text{Formula (5).}$$

The above-described coagulation value refers to the minimum amount of magnesium chloride (mol/g resin) necessary for agglomerating 1 g of resin particles in an emulsion having a solid content of 10% by mass, pH of 7 at 25° C. A higher coagulation value means that the emulsified particles (resin particles) are more stable (less prone to agglutinate) in the dispersion liquid.

In order to agglomerate the above-described crystalline resin particles and non-crystalline resin particles, the coagulation value is in a specified range. If C and D is smaller than $1\times10^{-5}$, the control of the particle diameter of the agglomerated particles is difficult. On the other hand, if C and D is larger than $1\times10^{-1}$, aggregation is hard to occur, and the control of the particle diameter is difficult.

Further, the coagulation value C of the crystalline resin is less than the coagulation value D of the non-crystalline resin. As such, the content of the crystalline resin in the impalpable powder of the toner is reduced by agglomerating the crystalline resin earlier.

The coagulation values C and D of the above-described crystalline resin and non-crystalline resin are preferably each satisfy the relationship represented by the following formula (3') to (5').

$$1\times10^{-3}\leqq C\leqq5\times10^{-2} \quad \text{Formula (3')}$$

$$1\times10^{-3}\leqq D\leqq5\times10^{-2} \quad \text{Formula (4')}$$

$$C<D \quad \text{Formula (5')}$$

As an example of the method for producing the electrostatic latent image developing toner of the invention, a production method by an emulsion aggregation method is described below.

The emulsion aggregation method comprises an emulsion process for emulsifying the materials composing the toner to form resin particles (emulsified particles), an aggregation process for agglutinating the resin particles to form agglomerated particles, and a fusion process for fusing the agglomerated particles. The emulsion aggregation method is capable of narrowing the particle diameter distribution with toner particles having a small diameter, thus the proportion of the impalpable powder toner is decreased.

(Emulsification Process)

The crystalline resin particles may be formed, for example, by applying a shearing force to a mixed solution of an aqueous medium and a crystalline resin using a disperser. In that time, particles may be formed with the viscosity of the resin component reduced by heating. Further, a dispersant of the crystalline resin particles may be used for stabilizing the dispersed resin particles. Alternatively, if the resin is soluble in an oil based solvent having relatively low solubility in water, a dispersion liquid of the crystalline resin particles may be prepared by dissolving the resin in the solvent, and dispersing the solution in a particle form in water together with a dispersant or a polymer electrolyte, followed by heating or decomposed to perspire the solvent.

Also, for the cases with a non-crystalline resin, a dispersion liquid of the non-crystalline resin particles may be prepared according to the above-described procedure.

Examples of the aqueous medium include water such as distilled water or ion-exchanged water; and alcohols, and preferably water alone.

Further, examples of the dispersant used in the emulsification process include water-soluble polymers such as polyvinyl alcohol, methyl cellulose, ethyl cellulose, hydroxyethyl cellulose, carboxymethyl cellulose, sodium polyacrylate, or sodium polymethacrylate; anionic surfactants such as sodium dodecylbenzenesulfonate, sodium octadecylsulfate, sodium oleate, sodium laurate, or potassium stearate, cationic surfactants such as laurylamine acetate, stearylamine acetate, or lauryltrimethyl ammonium chloride, amphoteric ionic surfactants such as lauryldimethylamine oxide, nonionic surfactants such as polyoxyethylene alkyl ether, polyoxyethylene alkylphenyl ether, or polyoxyethylene alkylamine; and inorganic salts such as tricalcium phosphate, aluminum hydroxide, calcium sulfate, calcium carbonate, or barium carbonate.

As described above, in the method for producing the toner of the invention, the content of the crystalline resin in the impalpable powder toner is decreased by controlling the coagulation value of the crystalline resin particles and non-crystalline resin particles.

Here, the coagulation value (or critical aggregation concentration) in the invention is further described. As described above, the coagulation value in the invention refers to the minimum amount of magnesium chloride (mol/g resin) necessary for agglomerating 1 g of resin particles in an emulsion having a solid content of 10% by mass, pH of 7 at 25° C. In general, a coagulation value (or critical aggregation concentration) is idiomatically used as an index of dispersion stability of an emulsion or suspension, dispersibility of a dispersant or cohesive force of a coagulant. The method for determining the coagulation value is selected from various methods according to the purpose, and by which the chemical stability of the emulsion may be evaluated according to the evaluation conditions. In the invention, the coagulation value was determined with an emulsion having a solid content equivalent to that used for preparing a toner, and an aqueous solution of magnesium chloride as a test coagulant for determining a broad range of coagulation value.

The method for determining the coagulation value in the invention is further described below.

—Method for Determining the Coagulation Value—

Preparation of Test Emulsion

In the first place, an emulsion (resin particle dispersion liquid) as a sample was prepared with a solid content concentration of 12.5% by mass, pH of 7, at 25° C. Nitric acid and sodium hydrate were used to adjust the pH.

Preparation of Magnesium Chloride Aqueous Solution

Magnesium chloride dihydrate was dissolved in ion-exchanged water, and magnesium chloride aqueous solutions having concentrations of $1.0\times10^{-5}$ to 5.0 mol/l were prepared.

Coagulation Test

The above-described emulsion was mixed with different concentrations of aqueous solution of magnesium chloride at a mass ratio of 8:2 (emulsion:aqueous solution of magnesium chloride) to make a whole solid content of 10% by mass. Subsequently, the particle diameter was determined for each sample with a particle diameter distribution analyzer (LS Coulter, manufactured by Coulter). The results were plotted on a graph with concentration of magnesium chloride on the horizontal axis and particle diameter on the vertical axis, and the coagulation value (or critical aggregation concentration) was determined from the inflexion point on the graph.

In the invention, the coagulation values C and D of the crystalline resin particles and non-crystalline resin particles satisfy the relationship represented by the above-described formulae (3) to (5). In particular, as represented by the formula (5), the coagulation value D of the non-crystalline resin particles is equal to or larger than the coagulation value C of the crystalline resin particles.

Examples of the method for lessening the coagulation value C of the crystalline resin particles smaller than the coagulation value D of the non-crystalline resin particles include a method of using a highly hydrophilic polymerizable monomer for composing the resin, or a method of using a hydrophilic monomer as a copolymerization component, and the method of increasing the proportion of the polymerizable monomer component including the aromatic ring in the crystalline resin greater than the proportion of the polymerizable monomer component including the non-crystalline resin. Examples of the above-described highly hydrophilic monomers include compounds having a sulfonyl group or carboxyl group.

Specifically, for the above-described crystalline polyester resin and non-crystalline polyester resin, as the monomer for synthesizing the crystalline polyester resin, 1,8-octanediol, 1,9-nonanediol, 1,10-decanediol, 1,9-nonanedicarboxylic acid, 1,10-decanedicarboxylic acid, 1,12-dodecanedicarboxylic acid or the like is preferably used, and as the monomer for synthesizing the non-crystalline polyester resin, aromatic carboxylic acids such as terephthalic acid, isophthalic acid, phthalic anhydride, trimellitic anhydride, pyromellitic acid, or naphthalenedicarboxylic acid, or aromatic diols such as ethylene oxide adduct of bisphenol A or propylene oxide adduct of bisphenol A are preferably used.

The content of the resin particles contained in the emulsion in the above-described emulsification process is preferably in the range of 10 to 50% by mass, and more preferably in the range of 20 to 40% by mass. If the above-described content is less than 10% by mass, the particle diameter distribution widens, which may deteriorate the toner properties. On the other hand, if the content exceeds 50% by mass, uniform stirring is difficult, which may make it difficult to obtain a toner with a narrow particle diameter distribution and uniform properties.

A disperser used for dispersing the above-described emulsion is exemplified, such as a homogenizer, homomixer, pressurization kneader, extruder, or media disperser.

With regard to the size of the resin particles, the average particle diameter (volume average particle diameter) thereof is preferably in the range of 0.08 to 0.8 μm, more preferably in the range of 0.09 to 0.6 μm, and further preferably in the range of 0.10 to 0.5 μm.

Further, in the emulsification process using a polyester resin, in particular, it is more preferable to control the particle diameter and the content of impalpable powder of the crystalline polyester resin particles, and the particle diameter and the content of impalpable powder of the non-crystalline polyester resin particles for improving the properties of the toner of the invention.

Specifically, the particle diameter and the content of impalpable powder of 10 to 40 nm of the crystalline polyester resin particles are preferably 60 to 300 nm and 0 to 5% by mass, respectively, and the particle diameter and the content of impalpable powder of 10 to 40 nm of the non-crystalline polyester resin particles are preferably 60 to 300 nm and 0 to 5% by mass, respectively.

In the below-described aggregation process, particles having an approximate particle diameter tend to cause aggregation. In the aggregation process, particles having an average particle diameter are conditioned to readily cause aggregation, thus particles having a small particle diameter are less prone to aggregate, and less tend to increase in the particle diameter. Accordingly impalpable powder containing a larger proportion of crystalline resin than non-crystalline resin tends to occur. Therefore, the particle diameter distribution is adjusted as described above in order to improve the properties of the toner of the invention.

As described above, the particle diameter of the crystalline polyester resin particles and non-crystalline polyester resin particles is preferably in the range of 60 to 300 nm, and more preferably in the range of 150 to 250 nm. If the diameter is smaller than 60 nm, the resin particles are stable and may hard to be agglomerated. On the other hand, if the diameter exceeds 300 nm, the aggregation property of the resin particles is improved to facilitate the preparation of toner particles, but the particle diameter distribution of the toner may widen.

Further, the content of impalpable powder having a particle diameter of 10 to 40 nm in the crystalline polyester resin particles is preferably in the range of 0 to 5% by mass. The stability of the resin particles having a particle diameter of 60 to 300 nm is significantly different from the stability of the resin particles having a particle diameter of 10 to 40 nm. The resin particles of 10 to 40 nm, which are impalpable powder, have a high acid value in the resin, thus the particles are highly stable. Therefore the stability of the resin particles of 60 to 300 nm is relatively deteriorated, and the whole mechanism system is in an unstable state. In such a state, when the content of impalpable powder in the crystalline polyester resin particles is in the range of 0 to 5% by mass, the content of impalpable powder having a higher acid value than average is decreased, thus the stability of the resin particles of 60 to 300 nm becomes uniform. Accordingly in the emulsion aggregation method, a toner which exhibits a stable granulation behavior is produced.

Further, also for the non-crystalline polyester resin particles, when the content of impalpable powder of 10 to 40 nm is in the range of 0 to 5% by mass, impalpable powder having a higher acid value than average is reduced, thus particles of 60 to 300 nm with uniform stability are present in a larger proportion, which improves the storage stability of the resin particles, and narrows the particle diameter distribution of the toner granulated by the emulsion aggregation method.

On the other hand, if the content of impalpable powder in the non-crystalline resin particles is in the range of 0 to 5% by mass but the content of impalpable powder in the crystalline polyester resin particles is more than 5% by mass, the crystalline polyester resin particles contain more impalpable powder, thus the stability of the resin particles of 60 to 300 nm is relatively decreased. Therefore, when toner granulation is attempted by the emulsion aggregation method, emulsion particles with deteriorated particle stability are abundantly taken in the toner, which results in an impalpable powder toner in which the non-crystalline polyester resin is locally distributed. Accordingly, with regard to the toner properties, the fixing property in the toner portion may be poor, and the offset property may be deteriorated.

On the other hand, if the content of impalpable powder in the crystalline polyester resin particles is in the range of 0 to 5% by mass but the content of impalpable powder in the non-crystalline resin particles is more than 5% by mass, the stability of the resin particles of 60 to 300 nm in the non-crystalline resin is decreased. Therefore, when toner granulation is attempted by the emulsion aggregation method, a toner with an unstable granulation behavior and a wide particle diameter distribution is obtained, and it may be difficult to achieve a GSD p-under of 1.30 or lower.

Further, if both of the above-described content of impalpable powder in the crystalline polyester resin particles and the above-described content of impalpable powder in the non-crystalline resin particles exceeds 5% by mass, resin particles having deteriorated particle stability are mixed, thus toner granulation by the emulsion aggregation method will result in a toner having a significantly wide particle diameter distribution, and it may be further difficult to achieve a GSD p-under of 1.30 or lower.

As described above, in order to further improve the charging property, filming resistance, and cleanability, the content of impalpable powder in both the resin particles of the crystalline polyester resin and non-crystalline polyester resin is preferably in the range of 0 to 5% by mass.

The content of impalpable powder in respective resin particles is examined by the following procedure.

In the first place, a dispersion liquid of resin particles is centrifuged at 14,000 rpm for 4 hours with a centrifugal machine to be separated into a precipitate of resin particles and a white supernatant. The supernatant is dried, and observed under a scanning electron microscope (SEM) (trade name: S4700, manufactured by Hitachi, Ltd.); it is confirmed that the particle diameter of the dispersed particles is in the range of 10 to 40 nm. The supernatant is further dried with a freeze drier to obtain a solid of impalpable powder having a particle diameter of 10 to 40 nm, and the mass is determined to specify the content of impalpable powder.

(Aggregation Process)

In the above-described aggregation process, in the first place a dispersion liquid of the obtained crystalline resin particles, a dispersion liquid of the non-crystalline resin particles, a dispersion liquid of a pigment and others are mixed to make a mixed solution, and the solution is heated at a temperature equal to or lower than the glass transition temperature of the non-crystalline resin to cause aggregation, thus agglomerated particles are formed. The formation of the agglomerated particles is carried out by adjusting the pH of the mixed solution to the acidic side while stirred. The pH is preferably in the range of 2 to 7, more preferably in the range of 2.2 to 6, and further preferably in the range of 2.4 to 5. On this occasion, it is also effective to use a coagulant.

As the coagulant to be used, a surfactant having a polarity opposite to the polarity of the above-described surfactant used as the dispersant, as well as an inorganic metal salt, and a divalent or more metal complex are preferably used. In particular, a metal complex is particularly preferable because the usage of surfactant is reduced and the charging property is improved.

Examples of the above-described inorganic metal salt include metal salts such as calcium chloride, calcium nitrate, barium chloride, magnesium chloride, zinc chloride, aluminum chloride, or aluminum sulfate, and inorganic metal salt polymers such as polyaluminum chloride, polyhydroxy aluminum, or calcium polysulfide. Among them, aluminum salts and polymers thereof are particularly preferable. For obtaining a sharper particle diameter distribution, with regard to the valence of the inorganic metal salt, divalent is better than monovalent, trivalent is better than divalent and tetravalent is better than trivalent, and among those having the same valence, inorganic metal salt polymer of polymerization type is more suitable.

Further, a toner composed of core agglomerated particles whose surface is coated with non-crystalline resin particles may be prepared by additionally add a non-crystalline resin particles at the point when the above-described agglomerated particles has a desired particle diameter. In this case, the crystalline resin is hard to be exposed at the toner surface, which is preferable structure from the viewpoints of charging property and developability. Before the additional addition, the addition of a coagulant or the adjustment of the pH may be carried out.

(Fusion Process)

In the fusion process, the pH of the suspension of the agglomerated particles is increased to the range of 3 to 9 under the stirring conditions according to the above-described aggregation process, thereby the progress of the aggregation is stopped, and the agglomerated particles are fused by heating them at a temperature equal to or higher than the melting point of the above-described crystalline resin. Further, when the particles are coated with the above-described non-crystalline resin, the non-crystalline resin is also fused to coat the core agglomerated particles. The time for the above-described heating should be enough for fusion, and about 0.5 to 10 hours will suffice.

Cooling is performed after fusion, and fused particles are obtained. Further, crystallization may be promoted by slowing down the cooling rate, so-called slow cooling, in the cooling process in the vicinity of the melting point of the crystalline resin (in the range of melting point ±10° C.).

The fused particles obtained by fusion is subjected to a solid-liquid separation process such as filtration, and if necessary, a washing process, and a dry process to form toner particles.

In the invention, the surface of the toner particles may be treated with external additives such as a fluidizing agent or auxiliary agent. As an external additive, known particles may be used, for example, inorganic particles such as surface hydrophobitized silica particles, titanium oxide particles, alumina particles, cerium oxide particles, or carbon black, and polymer particles such as polycarbonate, polymethyl methacrylate, or silicone resin. It is preferable to use at least two or more of the above external additives, and at least one of the external additives has an average primary particle diameter preferably in the range of 30 nm to 200 nm, further preferably in the range of 30 nm to 180 nm.

If the average primary particle diameter of the external additive is smaller than 30 nm, although the initial flowability of the toner is favorable, the non-electrostatic adhesion force between the toner and photoreceptor will not be reduced, which may decrease the transfer efficiency to develop an image void, or deteriorate the evenness of the image (increase the variations in the concentration). Further, the particles are buried in the toner surface by the stress in the developing device, which may vary the charging property, and in turn cause problems such as the decrease in the copy concentration or fogging in the background area. If the average primary particle diameter is larger than 200 nm, the particles are readily detached from the toner surface, and may deteriorate the flowability.

<Electrostatic Latent Image Developer>

The electrostatic latent image developing toner of the invention is used as it is as a one-component developer, or as a two-component developer. When used as a two-component developer, the toner is used in combination with a carrier.

The carrier which may be used for the two-component developer is not particularly limited, and known carriers may be used. Examples thereof include magnetic metals such as iron oxide, nickel, or cobalt, magnetic oxides such as ferrite or magnetite, resin-coated carriers composed of these substances as a core material having a resin coating layer on the surface thereof, and magnetic dispersed carriers. Further, the carrier may be of resin dispersion type in which a conductive material or the like is dispersed in a matrix resin.

Examples of the coating resin and the matrix resin used for the carrier include, but not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, straight silicone resin comprising an organosiloxane bond or modifications thereof, fluorocarbon resin, polyester, polycarbonate, phenol resin, and epoxy resin.

Examples of the conductive material include, but not limited to, metals such as gold, silver, or copper, carbon black, as well as titanium oxide, zinc oxide, barium sulfate, aluminum borate, potassium titanate, tin oxide, and carbon black.

Examples of the core material of the carrier include magnetic metals such as iron, nickel, or cobalt, magnetic oxides such as ferrite or magnetite, and glass beads. For using a carrier in a magnetic brush method, the core material thereof is preferably a magnetic material. The volume average particle diameter of the core material for the carrier is commonly in the range of 10 to 500 μm, and preferably in the range of 30 to 100 μm.

Further, examples of the method for resin-coating the surface of the core material of the carrier include a method of coating the core material with a solution for forming a coating layer in which the above-described coating resin and, as needed, various additives have been dissolved in an appropriate solvent. The solvent is not particularly limited, and may be selected according to the type, application property and the like of the coating resin to be used.

Specific examples of the resin coating method include a dipping method in which the core material of the carrier is dipped in a solution for forming a coating layer, a spray method in which a solution for forming a coating layer is sprayed on the surface of the core material of the carrier, a fluid bed method in which a solution for forming a coating layer is sprayed with the core material of the carrier suspended by flowing air, and a kneader coater method in which the core material of the carrier is mixed with a solution for forming a coating layer in a kneader coater, subsequently the solvent is removed.

The volume average particle diameter distribution index GSDv of the carrier obtained as described above is preferably in the range of 1.15 to 1.35, and more preferably in the range of 1.15 to 1.25.

If the GSDv exceeds 1.35, small particle diameter toner is readily developed; thereby the effect of the above-described toner of the invention may not be readily achieved. Further, it is practically difficult to achieve a GSDv smaller than 1.15.

The above-described GSDv for the carrier was determined and calculated as follows. In the first place, the particle diameter distribution of the carrier determined using Multisizer II (manufactured by Beckman-Coulter) as a measuring device is plotted against the divided particle diameter range (channel) to draw a cumulative distribution for the volume of respective carrier from the small diameter side. The particle diameter corresponding cumulative 16% is defined as the volume average particle diameter D16*v* and the particle diameter corresponding to cumulative 84% is defined as the volume average particle diameter D84*v*. With these values, the volume average particle diameter distribution index GSDv is defined as $(D84v/D16v)^{1/2}$.

In the above-described two-component developer, the mixing ratio (mass ratio) between the toner of the invention and the above-described carrier is preferably roughly in the range of toner:carrier=1:100 to 30:100, and more preferably roughly in the range of 3:100 to 20:100.

<Image Forming Apparatus>

In the next place, the image forming apparatus of the invention using the electrostatic latent image developing toner of the invention is further described.

The image forming apparatus of the invention comprises a latent image holding member, a developing unit for developing an electrostatic latent image formed on the latent image holding member into a toner image by a developer, a transfer unit for transferring the toner image formed on the latent image holding member to a transfer receiving material, a fixing unit for fixing the toner image transferred to the transfer receiving material, and a cleaning unit for cleaning non-transferred remaining components off the latent image holding member by scraping the latent image holding member with a cleaning member, wherein the above-described developer is the electrostatic latent image developer of the invention.

In the image forming apparatus, for example, the portion including the above-described developing unit may be a cartridge structure (process cartridge) which is removable from the main unit of the image forming apparatus. As the process cartridge, the process cartridge of the invention which at least equips a developer holding member and accommodates the electrostatic latent image developer of the invention is preferably used.

An example of the image forming apparatus of the invention is illustrated below, but not limited thereto. Explanations are given only for main parts represented in the figures, and those for other parts are omitted.

FIG. 1 is a schematic block diagram showing a full color image forming apparatus of train-of-four tandem type. The image forming apparatus shown in FIG. 1 equips first to fourth image forming units 10Y, 10M, 10C, and 10K of electrophotographic type for outputting images of yellow (Y), magenta (M), cyan (C), and black (K), respectively, on the basis of the color-separated image data. These image forming units (hereinafter simply referred to as "units")10Y, 10M, 10C, and 10K are arranged in parallel in the horizontal direction a predetermined distance apart from each other. These units 10Y, 10M, 10C, and 10K may be process cartridges which are removable from the main unit of the image forming apparatus.

An intermediate transfer belt 20 as an intermediate transfer medium is extended in the superior region of the drawing of the units 10Y, 10M, 10C, and 10K through the units. The intermediate transfer belt 20 is wound around a driving roller 22 and a supporting roller 24 in contact with the inner surface of the intermediate transfer belt 20, the rollers being arranged apart from each other in the horizontal direction in the figure, in such a manner that the belt travels in the direction from the first unit 10Y to the fourth unit 10K. The supporting roller 24 is biased by a spring or the like (not shown) in a direction away from the driving roller 22, and a predetermined tension is applied to the intermediate transfer belt 20 wound around these rollers. An intermediate transfer medium cleaning device 30 is provided on the side of the image holding member of the intermediate transfer belt 20 opposite to the driving roller 22.

Further, four color toners of yellow, magenta, cyan, and black toners accommodated in toner cartridges 8Y, 8M, 8C, and 8K can be supplied to the development device (developing unit) 4Y, 4M, 4C, and 4K of 10Y, 10M, 10C, and 10K, respectively.

Since the above-described first to fourth units 10Y, 10M, 10C, and 10K have an equivalent structure, the first unit 10Y for forming a yellow image arranged on the upstream side in the traveling direction of the intermediate transfer belt is described as a typical example. Descriptions of the second to fourth units 10M, 10C, and 10K are omitted by assigning the same reference numerals as the first unit 10Y to the corresponding parts, wherein the numerals are followed by magenta (M), cyan (C), or black (K) in place of yellow (Y).

The first unit 10Y has a photoreceptor 1Y which works as an image holding member. Around the photoreceptor 1Y, a charging roller 2Y for charging the surface of the photoreceptor 1Y to a predetermined potential, an exposure device 3 for exposing the charged surface to a laser beam 3Y based on the color-separated image signals to form an electrostatic latent image, a development device (developing unit) 4Y for supplying a charged toner to the electrostatic latent image to develop an electrostatic latent image, a primary transfer roller (primary transfer unit) 5Y for transferring the developed toner image onto the intermediate transfer belt 20, and a photoreceptor cleaning device (cleaning unit) 6Y for removing the toner remaining on the surface of the photoreceptor 1Y after primary transfer are arranged in this order.

The primary transfer roller 5Y is arranged within the intermediate transfer belt 20 in a position opposed to the photoreceptor 1Y. Further, bias power supplies (not shown) for applying primary transfer bias are connected to each of the primary transfer rollers 5Y, 5M, 5C, and 5K. The bias power supplies are controlled by a control unit (not shown) to vary the transfer bias to be applied to the primary transfer rollers.

The action of forming a yellow image in the first unit 10Y is described below. In the first place, previous to the action, the surface of the photoreceptor 1Y is charged to a potential of about −600V to −800V by the charging roller 2Y.

The photoreceptor 1Y is formed on a conductive substrate (volume resistivity at 20° C.: $1\times10^{-6}$ Ωcm or less) as a laminate of photosensitive layers. The photosensitive layer normally has high resistance (resistance equivalent to that of common resins), and has the property of changing the specific resistance of the area irradiated with the laser beam 3Y. On this account, the laser beam 3Y is emitted to the surface of the charged photoreceptor 1Y via an exposure device 3 according to the image data for yellow transmitted from the control unit (not shown). The laser beam 3Y is radiated to the photosensitive layer on the surface of the photoreceptor 1Y, thereby an electrostatic latent image of yellow printing pattern is formed on the surface of the photoreceptor 1Y.

An electrostatic latent image is an image formed by charging on the surface of the photoreceptor 1Y, and is a so-called negative latent image formed as follows: irradiation with the laser beam 3Y decreases the specific resistance of the photosensitive layer in the irradiated area, thereby the charges on the surface of the photoreceptor 1Y pass through, while charges remain in the area which has not irradiated with the laser beam 3Y to form an image.

The electrostatic latent image formed on the photoreceptor 1Y as described above is rotated to the predetermined development position along with the traveling of the photoreceptor 1Y. Then, at the development position, the electrostatic latent image on the photoreceptor 1Y is developed into a visible image (developed image) by the development device 4Y.

The development device 4Y accommodates, for example, a yellow toner having a volume average particle diameter of 7 μm which at least contains a yellow colorant, a crystalline resin, and a non-crystalline resin. The yellow toner is friction-charged by being stirred in the development device 4Y to have an electric charge having the same polarity (negative polarity) with the electrified charge on the photoreceptor 1Y, and is held on the developer roll (developer holding member). Then the surface of the photoreceptor 1Y passes through the development device 4Y, thereby the yellow toner electrostatically adheres to the discharged latent image area on the surface of the photoreceptor 1Y, and the latent image is developed by the yellow toner. The photoreceptor 1Y formed with the yellow toner image keeps traveling at a predetermined rate, and the toner image developed on the photoreceptor 1Y is carried to a predetermined primary transfer position.

When the yellow toner image on the photoreceptor 1Y is carried to the primary transfer position, a predetermined primary transfer bias is applied to a primary transfer roller 5Y, and an electrostatic force from the photoreceptor 1Y toward the primary transfer roller 5Y is exerted on the toner image, thereby the toner image on the photoreceptor 1Y is transferred onto the intermediate transfer belt 20. The applied transfer bias has a positive polarity opposite to the negative polarity of the toner, and for example, in the first unit 10Y, the bias is controlled by the control unit (not shown) to about +10 μA.

On the other hand, the toner remaining on the photoreceptor 1Y is removed and collected by a cleaning device 6Y.

Further, the primary transfer bias applied to primary transfer rollers 5M, 5C, and 5K in the second unit 10M and afterward is also controlled according to the first unit.

Then, the intermediate transfer belt 20 onto which the yellow toner image has been transferred by the first unit 10Y is sequentially carried through the second to fourth units 10M, 10C, and 10K, and the toner images of each color are overlaid and multilayer transferred.

The intermediate transfer belt 20 onto which a four color toner image is multilayer transferred through the first to fourth units comes to a secondary transfer part, which is constituted by the intermediate transfer belt 20, the supporting roller 24 in contact with the inner surface of the intermediate transfer belt 20, and a secondary transfer roller (secondary transfer unit) 26 arranged on the intermediate transfer belt 20 on the image holding side. On the other hand, a recording paper (transfer receiving material) P is fed at a predetermined time via a feeding mechanism to the gap where the secondary transfer roller 26 and the intermediate transfer belt 20 are pressed against each other under pressure, and a predetermined secondary transfer bias is applied to the supporting roller 24. At this time, the applied transfer bias has the same polarity (−) with the polarity of the toner (−), thereby an electrostatic force from the intermediate transfer belt 20 toward the recording paper P is exerted on the toner image, and the toner image on the intermediate transfer belt 20 is transferred onto the recording paper P. The secondary transfer bias is determined according to the resistance detected by a resistance detection unit (not shown) for detecting the resistance in the secondary transfer part, and is subjected to voltage control.

Subsequently, the recording paper P is sent to a fixing device (fixing unit) 28, the toner image is heated, and the color-superimposed toner image is melted and fixed on the recording paper P. The recording paper P on which the fixing of the color image has been completed is carried toward an ejection part, thus a series of steps for forming a color image is finished.

The image forming apparatus exemplified above has a structure in which a toner image is transferred to the recording paper P via the intermediate transfer belt 20, but is not limited to the structure, and may have a structure in which a toner image is transferred to a recording paper directly from the photoreceptor.

<Process Cartridge, Toner Cartridge>

Figure 2:
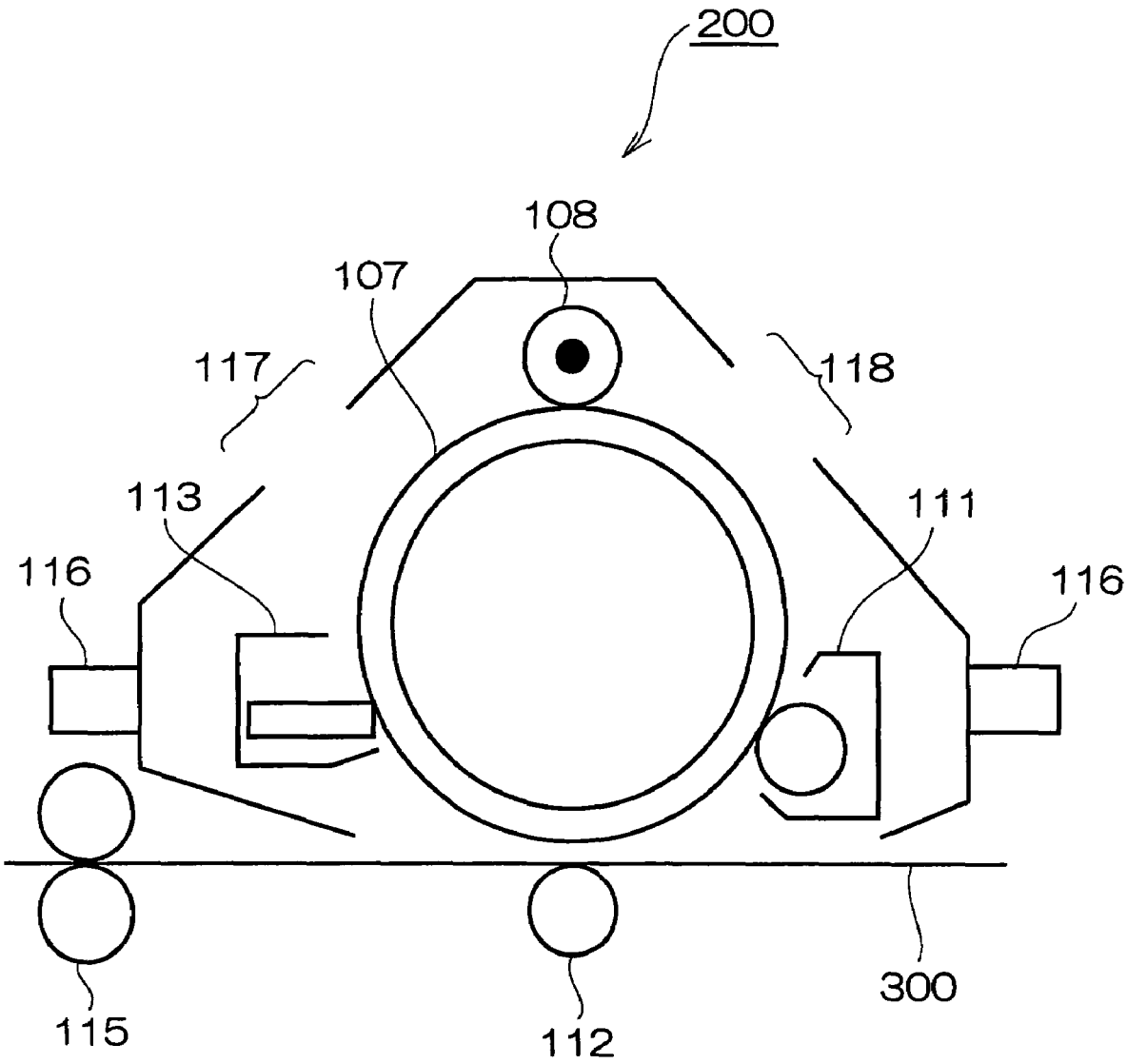
FIG. 2 is a schematic block diagram representing an example of the process cartridge of the invention.

FIG. 2 is a schematic block diagram showing a preferable example of the process cartridge which accommodates the electrostatic latent image developer of the invention. A process cartridge 200 integrates a photoreceptor 107 with a charging roller 108, a development device 111, a photoreceptor cleaning device (cleaning unit) 113, an opening 118 for exposure, and an opening 117 for discharging exposure using a mounting rail 116. The numeral 300 in FIG. 2 represents a recording paper.

The process cartridge 200 is removable from the main unit of the image forming apparatus including a transfer device 112, a fixing device 115, and other components (not shown), and composes the image forming apparatus together with the main unit of image forming apparatus.

The process cartridge shown in FIG. 2 includes a charging device 108, a development device 111, a cleaning device (cleaning unit) 113, and an opening 118 for exposure, and an opening 117 for discharging exposure. These devices may be selectively combined. The process cartridge of the invention includes, in addition to the photoreceptor 107, at least one selected from the group consisting of the charging device 108, development device 111, cleaning device (cleaning unit) 113, opening 118 for exposure, and opening 117 for discharging exposure.

In the next place, the toner cartridge of the invention is further described. The toner cartridge of the invention is removably mounted to the image forming apparatus, wherein at least in the toner cartridge which accommodates the toner to be fed to the developing unit provided in the above-described image forming apparatus, the above-described toner is the toner of the invention. The toner cartridge of the invention suffices as long as it accommodates at least a toner, and may accommodate, for example, a developer according to the mechanism of the image forming apparatus.

Accordingly, in an image forming apparatus having a structure in which a toner cartridge is removable, the use of a toner cartridge accommodating the toner of the invention allows easy feeding of the toner of the invention to the development device, thus excellent cleanability and filming resistance are maintained in continuous image formation.

The image forming apparatus shown in FIG. 1 is an image forming apparatus having a structure in which the toner cartridges 8Y, 8M, 8C, and 8K are removable, and the development devices 4Y, 4M, 4C, and 4K are connected to the toner cartridges corresponding to each development device (color) through toner feeding pipes (not shown). Further, when the toner accommodated in the toner cartridge draws to an end, the toner cartridge can be replaced.

All publication, patent applications, and technical standards mentioned in this specification are herein incorporated by reference to the same extent as if each individual publication, patent application, or technical standard was specifically and individually indicated to be incorporated by reference.

EXAMPLE

The invention is illustrated in detail by following Examples and Comparative Examples. Unless otherwise noted, "part" refers to "part by mass", and "%" refers to "% by mass".

<Determination Methods for Various Properties>

In the first place, the methods for determining the physical properties of the toner and others used in Examples and Comparative Examples (except for the above-mentioned method) are described.

(Determination Method of Molecular Weight and Molecular Weight Distribution)

In the invention, the molecular weight and molecular weight distribution of the crystalline polyester resin and others are determined under following conditions. GPC is carried out with a "HLC-8120GPC, SC-8020" (manufactured by Tosoh Corporation) apparatus, two columns, "TSK gel, Super HM-H (6.0 mm inner diameter×15 cm, manufactured by Tosoh Corporation)", and THF (tetrahydrofuran) as an eluent.

The experiment is carried out using an IR detector under following experiment conditions: sample concentration of 0.5%, flow rate of 0.6 ml/min, sample injection amount of 10 μl, and determination temperature 40° C. Further, the calibration curve is prepared from 10 samples, "Polystyrene Standard Sample TSK Standard": "A-500", "F-1", "F-10", "F-80", "F-380", "A-2500", "F-4", "F-40", "F-128", and "F-700" (manufactured by Tosoh Corporation).

(Volume Average Particle Diameter of Resin Particles, Colorant Particles, and Others)

The volume average particle diameter of the resin particles, colorant particles, and others is determined with a laser diffraction particle diameter distribution meter (LA-700, manufactured by Horiba, Ltd.).

(Determination Method of Melting Point and Glass Transition Temperature of Resins)

The melting point of the crystalline resin and the glass transition temperature (Tg) of the non-crystalline resin is, according to ASTM D3418-8, determined using a differential scanning calorimeter (DSC3110, heat analysis system 001, manufactured by Mac Science Co., Ltd.) at heating rate of 10° C./minute from 25° C. to 150° C. The melting point is a peak temperature of the endothermic peak, and the glass transition temperature is a temperature at the midpoint in the stepwise endothermic change.

<Synthesis of Resins>

(Crystalline Polyester Resin (1))

497 parts of ethylene glycol, 23.7 parts of sodium dimethyl 5-sulfoisophthalate, 22.8 parts of dimethyl fumarate, 857 parts of dimethyl sebacate, and 0.4 parts of dibutyl tin oxide as a catalyst are placed in a three neck flask which has been dried by heating, subsequently the vessel is depressurized to make inside inactive atmosphere by nitrogen gas, and the mixture is stirred by mechanical stirring at 180 rpm for 5 hours. Subsequently, the solution is slowly heated to 220° C. under reduced pressure, and stirred for 2 hours. When the solution becomes a viscous state, it is air-cooled to stop the reaction, thus 985 parts of a crystalline polyester resin (1) is synthesized. The weight average molecular weight (Mw) of the obtained crystalline polyester resin (1) is 8500, and the number average molecular weight (Mn) thereof is 3700 according to the molecular weight determination (polystyrene conversion) by gel permeation chromatography.

Further, the melting point (Tm) of the crystalline polyester resin (1) is determined by the above-described determination method using a differential scanning calorimeter (DSC); a distinct peak is shown, and the temperature of the peak top is 72° C. The content ratio between the copolymerization components, 5-sulfoisophthalate component, fumarate component, and sebacate component is calculated at 2:5:93 from the NMR spectrum of the resin.

(Non-Crystalline Polyester Resin (1))

194 parts of dimethyl terephthalate, 90 parts of 1,3-butanediol, and 0.3 parts of dibutyl tin oxide as a catalyst are placed in a two neck flask which has been dried by heating, subsequently the vessel is depressurized to make inside inactive atmosphere by nitrogen gas, and the mixture is stirred by mechanical stirring at 180 rpm for 5 hours. Subsequently, the solution is slowly heated to 230° C. under reduced pressure, and stirred for 2 hours. When the solution becomes a viscous state, it is air-cooled to stop the reaction, thus 240 parts of a non-crystalline polyester resin (1) (a non-crystalline polyester resin containing an acid-derived component composed of 100% aromatic dicarboxylic acid-derived component, and an alcohol-derived component composed of 100% aliphatic diol-derived component) are synthesized.

The weight average molecular weight (Mw) of the obtained non-crystalline polyester resin (1) is 9500, and the number average molecular weight (Mn) thereof is 4200 according to the molecular weight determination (polystyrene conversion) by gel permeation chromatography. The DSC spectrum of the non-crystalline polyester resin (1) is determined using the above-described differential scanning calorimeter (DSC); no distinct peak is shown, and a stepwise endothermic change is observed. The glass transition temperature as the midpoint of the endothermic change is 53° C.

<Preparation of Dispersion Liquids>

(Crystalline Polyester Resin Dispersion Liquid (1))

160 parts of the crystalline polyester resin (1), 233 parts of ethyl acetate, and 0.1 parts of a sodium hydrate aqueous solution (0.3N) are placed in a 500-ml separable flask, heated at 70° C., and stirred with a Three-one motor (manufactured by Shinto Scientific Co., Ltd.), thus a resin mixed solution is prepared. With the resin mixed solution is further stirred, 373 parts of ion-exchanged water is slowly added to cause phase inversion emulsification, and the solvent is removed, thus a crystalline polyester resin dispersion liquid (1) is obtained.

The volume average particle diameter of the resin particles in the crystalline polyester resin dispersion liquid (1) is 200 nm, and the solid content is 30%. Further, the coagulation value of the resin particles in the crystalline polyester resin dispersion liquid (1) is determined, and found to be $2.9\times10^{-3}$ (mol/g resin).

(Crystalline Polyester Resin Dispersion Liquid (2))

160 parts of the crystalline polyester resin (1), 233 parts of ethyl acetate, and 0.5 parts of a sodium hydrate aqueous solution (0.3N) are placed in a 500-ml separable flask, heated at 70° C., and stirred with a Three-one motor (manufactured by Shinto Scientific Co., Ltd.), thus a resin mixed solution is prepared. With the resin mixed solution is further stirred, 373 parts of ion-exchanged water is slowly added to cause phase inversion emulsification, and the solvent is removed, thus a crystalline polyester resin dispersion liquid (2) is obtained.

The volume average particle diameter of the resin particles in the crystalline polyester resin dispersion liquid (2) is 200 nm, and the solid content is 30%. Further, the coagulation value of the resin particles in the crystalline polyester resin dispersion liquid (2) is determined, and found to be $5.0\times10^{-6}$ (mol/g resin).

(Crystalline Polyester Resin Dispersion Liquid (3))

160 parts of the crystalline polyester resin (1), 233 parts of ethyl acetate, and 0.3 parts of a sodium hydrate aqueous solution (0.3N) are placed in a 500-ml separable flask, heated at 70° C., and stirred with a Three-one motor (manufactured by Shinto Scientific Co., Ltd.), thus a resin mixed solution is prepared. With the resin mixed solution is further stirred, 373 parts of ion-exchanged water is slowly added to cause phase inversion emulsification, and the solvent is removed, thus a crystalline polyester resin dispersion liquid (3) is obtained.

The volume average particle diameter of the resin particles in the crystalline polyester resin dispersion liquid (3) is 200 nm, and the solid content is 30%. Further, the coagulation value of the resin particles in the crystalline polyester resin dispersion liquid (3) is determined, and found to be $7.8\times10^{-5}$ (mol/g resin).

(Non-Crystalline Polyester Resin Dispersion Liquid (1))

160 parts of the non-crystalline polyester resin (1), 233 parts of ethyl acetate, and 0.1 parts of a sodium hydrate aqueous solution (0.3N) are placed in a 500-ml separable flask, heated at 70° C., and stirred with a Three-one motor (manufactured by Shinto Scientific Co., Ltd.), thus a resin mixed solution is prepared. With the resin mixed solution is further stirred, 373 parts of ion-exchanged water is slowly added to cause phase inversion emulsification, and the solvent is removed, thus a non-crystalline polyester resin dispersion liquid (1) is obtained.

The volume average particle diameter of the resin particles in the non-crystalline polyester resin dispersion liquid (1) is 200 nm, and the solid content is 30%. Further, the coagulation value of the resin particles in the non-crystalline polyester resin dispersion liquid (1) is determined, and found to be $1.4\times10^{-2}$ (mol/g resin).

(Non-Crystalline Polyester Resin Dispersion Liquid (2))

160 parts of the non-crystalline polyester resin (1), 233 parts of ethyl acetate, and 0.5 parts of a sodium hydrate aqueous solution (0.3N) are placed in a 500-ml separable flask, heated at 70° C., and stirred with a Three-one motor (manufactured by Shinto Scientific Co., Ltd.), thus a resin mixed solution is prepared. With the resin mixed solution is further stirred, 373 parts of ion-exchanged water is slowly added to cause phase inversion emulsification, and the solvent is removed, thus a non-crystalline polyester resin dispersion liquid (2) is obtained.

The volume average particle diameter of the resin particles in the non-crystalline polyester resin dispersion liquid (2) is 200 nm, and the solid content is 30%. Further, the coagulation value of the resin particles in the non-crystalline polyester resin dispersion liquid (2) is determined, and found to be $8.0\times10^{-6}$ (mol/g resin).

(Non-Crystalline Polyester Resin Dispersion Liquid (3))

160 parts of the non-crystalline polyester resin (1), 233 parts of ethyl acetate, and 0.03 parts of a sodium hydrate aqueous solution (0.3N) are placed in a 500-ml separable flask, heated at 70° C., and stirred with a Three-one motor (manufactured by Shinto Scientific Co., Ltd.), thus a resin mixed solution is prepared. With the resin mixed solution is further stirred, 373 parts of ion-exchanged water is slowly added to cause phase inversion emulsification, and the solvent is removed, thus a non-crystalline polyester resin dispersion liquid (3) is obtained.

The volume average particle diameter of the resin particles in the non-crystalline polyester resin dispersion liquid (3) is 200 nm, and the solid content is 30%. Further, the coagulation value of the resin particles in the non-crystalline polyester resin dispersion liquid (3) is determined, and found to be $7.8\times10^{-4}$ (mol/g resin).

(Non-Crystalline Polyester Resin Dispersion Liquid (4))

160 parts of the non-crystalline polyester resin (1), 233 parts of ethyl acetate, and 0.35 parts of a sodium hydrate aqueous solution (0.3N) are placed in a 500-ml separable flask, heated at 70° C., and stirred with a Three-one motor (manufactured by Shinto Scientific Co., Ltd.), thus a resin mixed solution is prepared. With the resin mixed solution is further stirred, 373 parts of ion-exchanged water is slowly added to cause phase inversion emulsification, and the solvent is removed, thus a non-crystalline polyester resin dispersion liquid (4) is obtained.

The volume average particle diameter of the resin particles in the non-crystalline polyester resin dispersion liquid (4) is 200 nm, and the solid content is 30%. Further, the coagulation value of the resin particles in the non-crystalline polyester resin dispersion liquid (4) is determined, and found to be $8.2\times10^{-2}$ (mol/g resin).

(Releasing Agent Dispersion Liquid)

Paraffin wax (HNP-9, melting point: 75° C., manufactured by Nippon Seiro Co., Ltd.): 50 parts Anionic surfactant (NEOGEN RK, manufactured by Dai-Ichi Kogyo Seiyaku Co., Ltd.): 0.5 parts Ion-exchanged water: 200 parts The above components are mixed and heated to 95° C., and dispersed using a homogenizer (Ultraturrax T50, manufactured by IKA Co.), followed by dispersion treatment in a manton gaulin high pressure homogenizer (manufactured by Gaulin Co., Ltd.), thus a releasing agent dispersion liquid (solids content concentration: 20%) in which a releasing agent having a volume average particle diameter of 0.23 μm is dispersed is prepared.

(Colorant Dispersion Liquid)

Cyan pigment (Pigment Blue 15:3 (copper phthalocyanine) manufactured by Dainichiseika Color & Chemicals Mfg. Co., Ltd.): 1000 parts Anionic surfactant (NEOGEN R, manufactured by Dai-Ichi Kogyo Seiyaku Co., Ltd.): 15 parts Ion-exchanged water: 9000 parts The above components are mixed, dissolved, and dispersed for about 1 hour with a high pressure impact disperser (Ultimizer HJP30006, manufactured by Sugino Machine Limited), thus a colorant dispersion liquid in which a colorant (cyan pigment) is dispersed is prepared. The volume average particle diameter of the colorant (cyan pigment) in the colorant dispersion liquid is 0.16 μm, and the solids content concentration thereof is 23%.

<Production of Carrier>

(Carrier 1)

Ferrite particles (volume average particle diameter: 35 μm, GSDv: 1.20): 100 parts Toluene: 14 parts Perfluoroacrylate copolymer (critical surface tension: 24 dyn/cm): 1.6 parts Carbon black (trade name: VXC-72, manufactured by Cabot Corporation, volume resistivity: 100 Ωcm or less): 0.12 parts Crosslinking melamine resin particles (average particle diameter: 0.3 μm, insoluble in toluene): 0.3 parts In the first place, to the perfluoroacrylate copolymer, carbon black diluted with toluene is added, and dispersed in a sand mill. Subsequently, the above-described components except for ferrite particles are dispersed in the dispersion for 10 minutes with a stirrer, thus a coating layer forming solution is prepared. Subsequently, the coating layer forming solution and ferrite particles are placed in a vacuum deaerating kneader, stirred at a temperature of 60° C. for 30 minutes, and then decompressed to evaporate toluene, thus a resin coating layer is formed to obtain a carrier 1. The volume average particle diameter distribution index GSDv of the carrier 1 is 1.20.

(Carrier 2)

A carrier 2 is obtained in the same manner with the carrier 1 except that ferrite particles used in the production of the carrier 1 is replace with that having a volume average particle diameter of 35 μm and a GSDv of 1.40. The volume average particle diameter distribution index GSDv of the carrier 2 is 1.40.

Example 1

(Production of Toner (1))

Crystalline polyester resin dispersion liquid (1): 125 parts

Non-crystalline polyester resin dispersion liquid (1): 325 parts

Colorant dispersion liquid: 21.74 parts

Releasing agent dispersion liquid: 50 parts

Nonionic surfactant (IGEPAL CA 897): 1.40 parts

The above-described raw materials are place in a 2-L cylindrical stainless steel vessel, and mixed by being dispersed at 4000 rpm for 10 minutes under a shearing force by using a homogenizer (Ultraturrax T50, manufactured by IKA Co.,). Subsequently, 1.75 parts of a 10% nitric acid aqueous solution of polyaluminum chloride as a coagulant is slowly added dropwise, mixed by being dispersed at 5000 rpm for 15 minutes by using the homogenizer, thus a raw material dispersion liquid is obtained.

Thereafter, the raw material dispersion liquid is transferred to a polymerization vessel equipped with a stirring apparatus and a thermometer, heating is initiated with a mantle heater, and the growth of the agglomerated particles is promoted at 42° C. At that time, the pH of the raw material dispersion liquid is adjusted between 2.2 and 3.5 with a 0.3 N nitric acid solution or a 1N sodium hydrate aqueous solution. The raw material dispersion liquid is maintained in the above-described pH range for about 2 hours, thus agglomerated particles are formed. The volume average particle diameter of the agglomerated particles as determined by Multisizer II using an aperture having an aperture diameter of 50 μm (manufactured by Beckman-Coulter) is 5.4 μm.

Subsequently, 100 parts of the non-crystalline polyester resin dispersion liquid (1) are further added to attach the resin particles of the non-crystalline polyester resin (1) to the surface of the above-described agglomerated particles. Further the temperature is increased to 44° C., and the agglomerated particles are conditioned with the size and shape of the particles are examined with an optical microscope and Multisizer II. Thereafter, the pH was increased to 8.0, and then the temperature is increased to 95° C. to fuse the agglomerated particles. After the fusion of the agglomerated particles is confirmed with an optical microscope, the pH was lowered to 6.0 with the temperature is kept at 95° C., heating is stopped 1 hour later, and cooled at a cooling rate of 1.0° C./minute. Thereafter, screening is performed with a 20 μm mesh, water washing is repeated, and then dried with a vacuum drying machine to obtain toner particles (1). The obtained toner particle (1) has a volume average particle diameter of 6.2 μm, and a GSDp-under of 1.20.

To 100 parts of the toner particles, 1.0% of surface hydrophobized silica particles having a primary particle diameter of 40 nm (hydrophobic silica RX50, manufactured by Nippon Aerosil Co., Ltd.), and 1.0% of metatitanium acid compound particles having a primary particles average diameter of 20 nm, which is a reaction product of 100 parts of metatitanium acid, 40 parts of isobutyltrimethoxysilane, and 10 parts of trifluoropropyltrimethoxysilane, are added as external additives, and mixed 5 minutes in a Henschel mixer. Further the mixture is sieved through an ultrasonic vibrating sieve (manufactured by Dalton Co., Ltd.) to obtain a toner (1).

(Composition on the Impalpable Powder Side (B/A×100))

The toner (1) is treated with an Elbow Jet classifier to classify the large particle diameter side, thus a toner (1') having a D50T of 3.0 μm. The toner (1) and (1') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 20.0% and 14.0%, respectively, and (B/A)×100 is 70.

(Preparation of Developer)

36 parts of the obtained toner (1) and 414 parts of the above-described carrier 1 are placed in a 2-L V blender, stirred for 20 minutes, subsequently sieved at 212 μm, thus a developer (1) is prepared.

(Various Evaluations of Toner)

—Evaluation of Cleanability and Filming Resistance—

The obtained developer (1) is loaded in a developing device of train-of-four tandem type (DocuCentre Color 500, manufactured by Fuji Xerox Co., Ltd.) shown in FIG. 1, and allowed to stand for 24 hours in an environment of 28° C./85% RH. Thereafter, the sample is placed in a modified DocuCentre Color 500 which has been adjusted to allow On/Off of transfer current, and the apparatus is adjusted such that a half tone image having a toner deposition of 0.1 mg/cm$^2$ is developed on a photoreceptor under the above-described environment, wherein image formation is performed on 5000 sheets with transfer current Off (no transfer is performed).

At that time, image transfer is performed with transfer current On at intervals of every 500 sheets to examine the image, and the image is inspected for cleaning defect by the following criteria.

A: No cleaning defect is detected up to 5000 sheets.

B: Slight cleaning defect is detected on the 5000th sheet, but gives no practical problem.

C: Cleaning defect is detected before the 5000th sheet and not allowable.

Further, the surface of the photoreceptor is inspected by visual observation at intervals of every 500 sheets, and filming on the photoreceptor surface is evaluated by the following criteria.

A: No filming is detected up to 5000 sheets.

B: Slight filming is detected on the 5000th sheet, but gives no practical problem.

C: Filming is detected before the 5000th sheet and not allowable.

The results are shown in Table 1.

—Evaluation of Charging Properties—

The obtained developer (1) is loaded into a developing device of the modified DocuCentre Color 500 (manufactured by Fuji Xerox Co., Ltd.), and allowed to stand for 24 hours in an environment of 28° C./85% RH. Thereafter, the developing device is idled for three minutes in the adjustment mode of the developing device, subsequently the developer is collected from the development sleeve, and the charge amount of the toner is measured with a blow-off charge meter (TB200, manufactured by Toshiba Chemical Co., Ltd.). The results are shown in Table 1.

—Evaluation of Fixing Property—

The obtained developer (1) is loaded into a developing device of the DocuCentre Color 500 with no fixing device, and an unfixed image is collected. The image is a solid image of 40 mm×50 mm with a toner deposition of 0.50 mg/cm$^2$, and a mirror coat platinum paper (basis weight: 127 gsm) is used as the recording paper. Subsequently, the fixing device of DocuCentre Color 500 (manufactured by Fuji Xerox Co., Ltd.) is modified such that the fixing temperature is valuable, and the low temperature fixing property and offset resistance of the image are evaluated with the fixing temperature is stepwise increased from 90° C. to 140° C. The low temperature fixing property is evaluated as follows: the fixed image is bent for 10 seconds using a weight of load (60 sN/m$^2$), then recovered, and the fixing temperature at the point when the maximum width of the image defect part on the bent part is 0.3 mm or less is defined as the lowest fixing temperature. The results are shown in Table 1.

Example 2

A toner (2) is obtained in the same manner as the production of the toner in Example 1, except that the addition amount of the crystalline polyester resin dispersion liquid (1) is changed from 125 parts to 100 parts. The volume average particle diameter of the toner (2) is 5.9 μm.

(Composition on the Impalpable Powder Side)

The toner (2) is treated with an Elbow Jet classifier to classify the large particle diameter side, thus a toner (2') having a D50T of 2.5 μm. The toner (2) and (2') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 16% and 12.6%, respectively, and (B/A)×100 is 79. Using the toner (2), a developer is prepared in the same manner as Example 1, and various evaluations are conducted on the toner. The results are shown in Table 1 together with the toner properties.

Example 3

A toner (3) is obtained in the same manner as the production of the toner in Example 1, except that the addition amount of the crystalline polyester resin dispersion liquid (1) is changed from 125 parts to 150 parts. The volume average particle diameter of the toner (3) is 6.0 μm.

(Composition on the Impalpable Powder Side)

The toner (3) is treated with an Elbow Jet classifier to classify the large particle diameter side, thus a toner (3') having a D50T of 3.5 μm. The toner (3) and (3') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 19.0% and 16.3%, respectively, and (B/A)×100 is 86.

Using the toner (3), a developer is prepared in the same manner as Example 1, and various evaluations are conducted on the toner. The results are shown in Table 1 together with the toner properties.

Example 4

A toner (4) is obtained in the same manner as the production of the toner in Example 1, except that the addition amount of the 10% nitric acid aqueous solution of polyaluminum chloride used as a coagulant is changed from 1.75 parts to 2.00 parts. The volume average particle diameter of the toner (4) is 5.8 μm, and the GSDp-under thereof is 1.28.

(Composition on the Impalpable Powder Side)

The toner (4) is treated with an Elbow Jet classifier to classify the large particle diameter side, thus a toner (4') having a D50T of 3.9 μm. The toner (4) and (4') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 16.0% and 12.3%, respectively, and (B/A)×100 is 77.

Using the toner (4), a developer is prepared in the same manner as Example 1, and various evaluations are conducted on the toner. The results are shown in Table 1 together with the toner properties.

Example 5

A toner (5) is obtained in the same manner as the production of the toner in Example 1, except that the addition amount of the 10% nitric acid aqueous solution of polyaluminum chloride used as a coagulant is changed from 1.75 parts to 1.50 parts. The volume average particle diameter of the toner (5) is 5.5 μm, and the GSDp-under thereof is 1.34.

(Composition on the Impalpable Powder Side)

The toner (5) is treated with an Elbow Jet classifier to classify the large particle diameter side, thus a toner (5') having a D50T of 3.5 μm. The toner (5) and (5') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 16.0% and 10.2%, respectively, and (B/A)×100 is 64.

Using the toner (5), a developer is prepared in the same manner as Example 1, and various evaluations are conducted on the toner. The results are shown in Table 1 together with the toner properties.

Example 6

A toner (6) is obtained in the same manner as the production of the toner in Example 1, except that 125 parts of the crystalline polyester resin dispersion liquid (3) is used in place of 125 parts of the crystalline polyester resin dispersion liquid (1). The volume average particle diameter of the toner (6) is 5.8 μm, and the GSDp-under thereof is 1.24.

(Composition on the Impalpable Powder Side)

The toner (6) is treated with an Elbow Jet classifier to classify the large particle diameter side, thus a toner (6') having a D50T of 3.1 μm. The toner (6) and (6') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 16.0% and 11.2%, respectively, and (B/A)×100 is 70.

Using the toner (6), a developer is prepared in the same manner as Example 1, and various evaluations are conducted on the toner. The results are shown in Table 1 together with the toner properties.

Example 7

A toner (7) is obtained in the same manner as the production of the toner in Example 1, except that 325 parts of the non-crystalline polyester resin dispersion liquid (4) is used in place of 325 parts of the non-crystalline polyester resin dispersion liquid (1). The volume average particle diameter of the toner (7) is 5.9 μm.

Using the toner (7), a developer is prepared in the same manner as Example 1, and various evaluations are conducted on the toner. The results are shown in Table 1 together with the toner properties.

Example 8

A developer is prepared in the same manner as Example 1, except that the carrier 2 is used in place of the carrier 1, and various evaluations are conducted on the toner. The results are shown in Table 1 together with the toner and carrier properties.

Comparative Example 1

A toner (8) is obtained in the same manner as the production of the toner in Example 1, except that the crystalline polyester resin dispersion liquid (2) is used in place of the crystalline polyester resin dispersion liquid (1). The volume average particle diameter of the toner (8) is 6.1 μm, and the GSDp-under thereof is 1.28.

(Composition on the Impalpable Powder Side)

The toner (8) is treated with an Elbow Jet classifier to classify the large particle diameter side, thus a toner (8') having a D50T of 3.0 μm. The toner (8) and (8') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 16.0% and 6.4%, respectively, and (B/A)×100 is 40.

Using the toner (8), a developer is prepared in the same manner as Example 1, and various evaluations are conducted on the toner. The results are shown in Table 1 together with the toner properties.

Comparative Example 2

A toner (9) is obtained in the same manner as the production of the toner in Example 1, except that the non-crystalline polyester resin dispersion liquid (2) is used in place of the non-crystalline polyester resin dispersion liquid (1). The volume average particle diameter of the toner (9) is 5.8 μm, and the GSDp-under thereof is 1.38.

(Composition on the Impalpable Powder Side)

The toner (9) is treated with an Elbow Jet classifier to classify the large particle diameter side, thus a toner (9') having a D50T of 3.1 μm. The toner (9) and (9') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 16.0% and 19.2%, respectively, and (B/A)×100 is 120.

Using the toner (9), a developer is prepared in the same manner as Example 1, and various evaluations are conducted on the toner. The results are shown in Table 1 together with the toner properties.

Comparative Example 3

A toner (10) is obtained in the same manner as the production of the toner in Example 1, except that the non-crystalline polyester resin dispersion liquid (2) is used in place of the non-crystalline polyester resin dispersion liquid (1), and the crystalline polyester resin dispersion liquid (2) is used in place of the crystalline polyester resin dispersion liquid (1). The volume average particle diameter of the toner (10) is 6.2 μm, and the GSDp-under thereof is 1.41.

(Composition on the Impalpable Powder Side)

The toner (10) is treated with an Elbow Jet classifier to classify the large particle diameter side, thus a toner (10') having a D50T of 2.8 μm. The toner (10) and (10') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 16.0% and 14.4%, respectively, and (B/A)×100 is 90.

Using the toner (10), a developer is prepared in the same manner as Example 1, and various evaluations are conducted on the toner. The results are shown in Table 1 together with the toner properties.

Comparative Example 4

A toner (11) is obtained in the same manner as the production of the toner in Example 1, except that the non-crystalline polyester resin dispersion liquid (3) is used in place of the non-crystalline polyester resin dispersion liquid (1). The volume average particle diameter of the toner (11) is 6.1 μm, and the GSDp-under thereof is 1.25.

(Composition on the Impalpable Powder Side)

The toner (11) is treated with an Elbow Jet classifier to classify the large particle diameter side, thus a toner (11') having a D50T of 3.8 μm. The toner (11) and (11') are subjected to DSC determination by the above-described method, and the each heat of fusion based on crystalline polyester resin is determined. From the result and the previously prepared calibration curve, the content of the crystalline polyester resin in the toner before and after classification A (%) and B (%) are determined; A and B are 16.0% and 17.6%, respectively, and (B/A)×100 is 110.

Using the toner (11), a developer is prepared in the same manner as Example 1, and various evaluations are conducted on the toner. The results are shown in Table 1 together with the toner properties.

TABLE 1

| | | Example 1 | Example 2 | Example 3 | Example 4 | Example 5 | Example 6 | Example 7 |
|---|---|---|---|---|---|---|---|---|
| Crystalline polyester resin | Dispersion liquid No. | (1) | (1) | (1) | (1) | (1) | (3) | (1) |
| | Coagulation value (mol/g) | $2.9 \times 10^{-3}$ | $2.9 \times 10^{-3}$ | $2.9 \times 10^{-3}$ | $2.9 \times 10^{-3}$ | $2.9 \times 10^{-3}$ | $7.8 \times 10^{-5}$ | $2.9 \times 10^{-3}$ |
| Non-crystalline polyester resin | Dispersion liquid No. | (1) | (1) | (1) | (1) | (1) | (1) | (4) |
| | Coagulation value (mol/g) | $1.4 \times 10^{-2}$ | $1.4 \times 10^{-2}$ | $1.4 \times 10^{-2}$ | $1.4 \times 10^{-2}$ | $1.4 \times 10^{-2}$ | $1.4 \times 10^{-2}$ | $8.2 \times 10^{-2}$ |
| GSDp-under | | 1.20 | 1.20 | 1.20 | 1.28 | 1.34 | 1.24 | 1.22 |
| (B/A) × 100 | | 70 | 79 | 86 | 77 | 64 | 70 | 80 |
| Carrier GSDv | | 1.20 | 1.20 | 1.20 | 1.20 | 1.20 | 1.20 | 1.20 |
| Cleanability | | A | A | A | A | A | A | A |
| Filming resistance | | A | A | B | B | B | A | A |
| Charge amount (μc/g) | | 40 | 45 | 37 | 38 | 37 | 36 | 41 |
| Lowest fixing temperature (° C.) | | 105 | 110 | 100 | 105 | 105 | 110 | 105 |

TABLE 1-continued

| | | Example 8 | Comparative Example 1 | Comparative Example 2 | Comparative Example 3 | Comparative Example 4 |
|---|---|---|---|---|---|---|
| Crystalline polyester resin | Dispersion liquid No. | (1) | (2) | (1) | (2) | (1) |
| | Coagulation value (mol/g) | $2.9 \times 10^{-3}$ | $5.0 \times 10^{-6}$ | $2.9 \times 10^{-3}$ | $5.0 \times 10^{-6}$ | $2.9 \times 10^{-3}$ |
| Non-crystalline polyester resin | Dispersion liquid No. | (1) | (1) | (2) | (2) | (3) |
| | Coagulation value (mol/g) | $1.4 \times 10^{-2}$ | $1.4 \times 10^{-2}$ | $8.0 \times 10^{-6}$ | $8.0 \times 10^{-6}$ | $7.8 \times 10^{-4}$ |
| GSDp-under | | 1.20 | 1.28 | 1.38 | 1.41 | 1.25 |
| (B/A) × 100 | | 80 | 40 | 120 | 95 | 110 |
| Carrier GSDv | | 1.40 | 1.20 | 1.20 | 1.20 | 1.20 |
| Cleanability | | A | B | C | C | B |
| Filming resistance | | B | A | C | B | C |
| Charge amount (μc/g) | | 40 | 44 | 25 | 31 | 26 |
| Lowest fixing temperature (° C.) | | 105 | 130 | 100 | 105 | 100 |

The results shown in Table 1 indicate that in Examples using the dispersion liquids of the crystalline polyester resin particles and non-crystalline polyester resin particles having a coagulation value satisfying the relationship represented by the above-described formulae (3) to (5), the proportion of the crystalline polyester resin is low on the classified impalpable powder side, and the cleanability, filming resistance, charging property, and fixing property are favorable.

On the other hand, in Comparative Example 1, the coagulation value of the crystalline polyester resin particles is lower than the specified range, thus B/A is too small, which is considered to develop a plenty of small diameter particles containing a large proportion of non-crystalline polyester resin component, and deteriorate the cleanability and fixing property.

In Comparative Example 2, the coagulation value of the non-crystalline polyester resin dispersion liquid is lower than the specified range, thus the aggregation property of the non-crystalline polyester resin particles is promoted, which increases the GSDp-under and B/A (i.e., the proportion of the crystalline polyester resin component is increased). Accordingly, the filming resistance, cleanability, and charging property are deteriorated.

In Comparative Example 3, the coagulation value in the dispersion liquid is below $10^{-5}$ for either of the crystalline polyester resin dispersion liquid and the non-crystalline polyester resin dispersion liquid, thus the aggregation property in the dispersion liquids is significantly widened, which widens the particle diameter distribution, and localizes the components in the toner. It is thus considered that the particles containing a large proportion of the non-crystalline polyester resin component deteriorate the filming resistance and cleanability, and the particles containing a large proportion of the crystalline polyester resin component deteriorate the charging property.

In Comparative Example 4, since the coagulation value in both of the dispersion liquids is higher than the specified range, although the particle diameter distribution is favorable, the coagulation value of the crystalline polyester resin dispersion liquid is higher than the coagulation value of the non-crystalline polyester resin dispersion liquid, which promotes the aggregation property of the non-crystalline polyester, and increases the proportion of the crystalline polyester resin component in the impalpable powder toner. As a result, the filming resistance, cleanability, and charging property are deteriorated.

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic latent image developing toner comprising:

a non-crystalline resin, wherein the non-crystalline resin is a non-crystalline polyester resin having a component derived from an aromatic dicarboxylic acid, a crystalline resin having a melting point of 50 to 100° C., wherein the crystalline resin is a crystalline polyester resin having a sulfonyl group, and a colorant, and satisfying the relationship represented by the following formula (1), wherein A represents the content of the crystalline resin (% by mass) in the entire toner, and B represents the content of the crystalline resin (% by mass) in a classified toner which has been prepared by classifying the toner such that the volume average particle diameter thereof is in the range of (⅕)×D50T to (⅔)×D50T, wherein D50T represents the volume average particle diameter of the entire toner:

$$50 \leqq (B/A) \times 100 \leqq 90 \qquad \text{Formula (1).}$$

2. The electrostatic latent image developing toner of claim 1, wherein A and B satisfy the relationship represented by the following formula (2):

$$50 \leqq (B/A) \times 100 \leqq 80 \qquad \text{Formula (2).}$$

3. The electrostatic latent image developing toner of claim 1, wherein the number average particles size distribution index of a small particle size side GSDp-under is in the range of 1.15 to 1.30.

4. The electrostatic latent image developing toner of claim 1, wherein the glass transition temperature (Tg) of the non-crystalline polyester resin is in the range of 50 to 80° C.

5. The electrostatic latent image developing toner of claim 1, wherein the solubility parameter SPA of the crystalline polyester resin and the solubility parameter SPB of the non-crystalline polyester resin satisfy the relationship represented by the following formula (6):

$$SPB-SPA<0.7 \qquad \text{Formula (6).}$$

6. The electrostatic latent image developing toner of claim 1, wherein the electrostatic latent image developing toner comprises a releasing agent, and the melting point of the releasing agent is in the range of 50 to 100° C.

7. The electrostatic latent image developing toner of claim 1, wherein a shape factor SF1 of the electrostatic latent image developing toner is in the range of 110 to 140.

8. An electrostatic latent image developer comprising a toner, wherein the toner is the electrostatic latent image developing toner of claim 1.

9. The electrostatic latent image developer of claim 8, wherein the electrostatic latent image developer comprises a carrier, and the volume average particle size distribution index GSDv of the carrier is in the range of 1.15 to 1.35.

10. A process cartridge comprising at least a developer holding member, and accommodating the electrostatic latent image developer of claim 8.

11. A toner cartridge accommodating at least a toner, wherein the toner is the electrostatic latent image developing toner of claim 1.

12. An image forming apparatus comprising a latent image holding member, a developing unit for developing an electrostatic latent image formed on the latent image holding member into a toner image by a developer, a transfer unit for transferring the toner image formed on the latent image holding member to a transfer receiving material, a fixing unit for fixing the toner image transferred to the transfer receiving material, and a cleaning unit for cleaning non-transferred remaining components off the latent image holding member by scraping the latent image holding member with a cleaning member, wherein the developer is the electrostatic latent image developer of claim 8.

* * * * *